US008172505B2

(12) United States Patent
Fujimoto et al.

(10) Patent No.: US 8,172,505 B2
(45) Date of Patent: May 8, 2012

(54) COOLING STRUCTURE

(75) Inventors: Shu Fujimoto, Tokyo (JP); Yoshitaka Fukuyama, Tokyo (JP); Takashi Yamane, Tokyo (JP); Masahiro Matsushita, Tokyo (JP); Toyoaki Yoshida, Tokyo (JP)

(73) Assignees: IHI Corporation (JP); Japan Aerospace Exploration Agency (JP)

( * ) Notice: Subject to any disclaimer, the term of this patent is extended or adjusted under 35 U.S.C. 154(b) by 724 days.

(21) Appl. No.: 12/279,452

(22) PCT Filed: Feb. 7, 2007

(86) PCT No.: PCT/JP2007/052107

§ 371 (c)(1),
(2), (4) Date: Jan. 22, 2009

(87) PCT Pub. No.: WO2007/094212

PCT Pub. Date: Aug. 23, 2007

(65) Prior Publication Data

US 2009/0126335 A1 May 21, 2009

(30) Foreign Application Priority Data

Feb. 14, 2006 (JP) ..... P2006-036810

(51) Int. Cl.
*F01D 5/18* (2006.01)

(52) U.S. Cl. ..... 415/115; 415/116; 416/97 R

(58) Field of Classification Search ..... 415/115, 415/116; 416/97 R
See application file for complete search history.

(56) References Cited

U.S. PATENT DOCUMENTS

| | | | | |
|---|---|---|---|---|
| 2,888,242 | A | 5/1959 | Williams | |
| 5,603,606 | A | 2/1997 | Glezer et al. | 416/97 |
| 5,752,801 | A | 5/1998 | Kennedy | 415/115 |
| 5,971,708 | A | 10/1999 | Lee | 416/97 |
| 6,092,983 | A | 7/2000 | Tomita et al. | 415/115 |
| 6,241,467 | B1 | 6/2001 | Zelesky et al. | 415/115 |
| 6,379,118 | B2 | 4/2002 | Lutum et al. | 416/97 |
| 6,382,907 | B1 | 5/2002 | Bregman et al. | 415/115 |
| 2005/0226726 | A1 | 10/2005 | Lee et al. | 416/97 |

FOREIGN PATENT DOCUMENTS

| | | |
|---|---|---|
| DE | 829 969 | 1/1952 |
| JP | 6-167201 | 6/1994 |
| JP | 9-507895 | 8/1997 |
| JP | T-09-511041 | 11/1997 |
| JP | 10-306706 | 11/1998 |
| JP | 10-311203 | 11/1998 |

(Continued)

OTHER PUBLICATIONS

S. Yamawaki, "Verifying Heat Transfer Analysis of High Pressure Cooled Turbine Blades and Disk", *Heat Transfer in Gas Turbine Systems* (*Annals of the New York Academy of Science*), New York, NY, The New York Academy of Science, 2001, vol. 934, pp. 505-512.

(Continued)

*Primary Examiner* — Asok Sarkar
(74) *Attorney, Agent, or Firm* — Ostrolenk Faber LLP

(57) ABSTRACT

In this cooling structure, a cooling flow path, which is meandering around a flow direction of a high temperature combustion gas, is provided in a structural body. The cooling flow path has an inflow path for a cooling air formed inside of the structural body; at least one straight flow path provided with intervals with respect to an axial line; and a turning flow path for communicating the end portions of the inflow path with the straight flow path or communicating with the end portions of the straight flow paths one after another.

15 Claims, 15 Drawing Sheets

FOREIGN PATENT DOCUMENTS

| | | |
|---|---|---|
| JP | 11-257008 | 9/1999 |
| JP | 2001-65306 | 3/2001 |
| JP | 2002-516944 | 6/2002 |
| JP | 2005-516944 | 6/2002 |
| JP | 2002-195003 | 7/2002 |
| JP | 2005-299636 | 10/2005 |
| WO | WO 95/26458 | 10/1995 |

OTHER PUBLICATIONS

J. Han et al., *Gas Turbine Heat Transfer and Cooling Technology*, United Kingdom, Taylor & Francis, 2000, p. 20.

International Search Report mailed May 15, 2007 in corresponding PCT International Application No. PCT/JP2007/052107.

Office Action for Japanese Application No. 2008-500456 mailed on Sep. 6, 2011.

COOLING STRUCTURE

CROSS-REFERENCE TO RELATED APPLICATIONS

The present application is a 35 U.S.C. §§371 national phase conversion of PCT/JP2007/052107, filed Feb. 7, 2007, which claims priority of Japanese Patent Application No. 2006-036810, filed Feb. 14, 2006, the contents of which are incorporated herein by reference. The PCT International Application was published in the Japanese language.

TECHNICAL FIELD

The present invention relates to a cooling structure for structural bodies such as turbine blade, turbine wall, or the like which comprise a turbine.

Priority is claimed on Japanese Patent Application No. 2006-036810, filed on Feb. 14, 2006, the content of which is incorporated herein by reference.

BACKGROUND ART

In recent years, in order to enhance the heat efficiency, the demand for operating turbines in higher temperature has increased, whereby the turbine inlet temperature reaches from 1200 to 1700 degrees Celsius. Under such high temperature, metal components, which are the structural bodies of the turbine, need to be cooled so as not to exceed a limit temperature of a material of the metal components. In order to cool the turbine components, cooling air paths are formed inside of the components and the cooling is performed from inside of the components. At this moment, high pressure air formed by a compressor is usually used as the cooling air. Therefore, the amount of air used for the cooling air affects the performance of a gas turbine directly.

A turbine blade is the turbine component which especially needs cooling. As a cooling structure for the turbine blade, the Impingement cooling structure in which an insert component for flowing the cooling air is prepared as a different component from the turbine blade and is assembled inside of the turbine blade (For example, Non Patent Document 1) or the Serpentine flow path cooling structure in which turning flow paths are formed inside of the turbine blade and the cooling air is circulated (For example, Patent Document 1 or Non Patent Document 2) are disclosed.

Patent document 1: Japanese Unexamined Patent Application, First Publication No. H06-167201.

Non Patent Document 1: Shigemichi Yamawaki, "Verifying Heat Transfer Analysis of High Pressure Cooled Turbine Blades and Disk", Heat transfer in gas turbine systems (Annals of the New York Academy of Science), (United States), the New York Academy of Science, 2001, Volume 934, pp. 505-512

Non Patent Document 2: Je-chin Han et al., "Gas Turbine heat transfer and cooling technology", (United Kingdom), Taylor & Francis, 2000, pp. 20

DISCLOSURE OF THE INVENTION

Problem to be Solved by the Invention

However, with the cooling structure disclosed in Non Patent Document 1, it is not possible to integrally assemble a turbine blade and extra manufacturing cost is needed to manufacture and insert the insert component. Also, even when the cooling structure is intended to apply to a three-dimensional bow blade (shaped in arch shape in height direction of a blade) for improving aerodynamic performance and the insert component is formed in three-dimensional shape, it is difficult to insert the insert component in the blade whereby the cooling structure cannot be employed.

Also, with the cooling structure disclosed in Non Patent Document 2, a cross section of the cooling flow path is extremely small at a portion where the cooling flow path is turned back 180 degrees, a pressure drop of the cooling air becomes large whereby it is impossible to obtain sufficient cooling performance. Furthermore, in order to realize the structure disclosed in Non Patent Document 2, manufacturability is not good since the shape of a ceramics core is complicated.

The present invention was achieved in view of the above circumstances, and has its main object to provide a cooling structure for maintaining and improving the cooling performance without wasting the cooling air by minimizing the pressure drop of the cooling air which circulates inside of the structural body comprising the turbine.

Means for Solving the Problem

In order to solve the above mentioned problems, as a first apparatus in accordance with the present invention, a cooling structure for a structural body comprising a turbine includes: a wall surface provided along a high temperature combustion gas flowing substantially in the axial direction of the turbine; a cooling flow path meandering around a flow direction of the high temperature combustion gas provided in the structural body; an inflow path of the cooling air formed inside of the structural body in which the cooling flow path extends in a direction substantially perpendicular to the axial direction; at least one straight flow path provided with intervals substantially in the axial direction, in which a length substantially the same as the length of the inflow path being a flow path width, and extended substantially in the normal direction of the wall surface by a finite length; and a turning flow path for communicating the ends of the inflow path with the straight flow path or communicating the ends of each of the straight paths one after the other.

With this invention, it is possible to increase the flow velocity at the straight flow path whereby it is possible to increase an impingement velocity of the cooling air to the wall surface.

As a second apparatus, a cooling structure of the first apparatus is employed, in which the wall surface is a suction surface and a pressure surface of the turbine blade, the cooling flow path has a first flow path and a second flow path directing from the center portion of the turbine blade to the leading edge thereof and to the trailing edge thereof respectively, each of the first flow path and the second flow path has the inflow path, the straight flow path, and the turning flow path. Each of the inflow paths of the first flow path and the second flow path is formed along the height direction of the turbine blade and the inflow paths are provided to be adjacent with one another.

With this invention, since the cooling air circulating the straight flow path impinges on the suction surface or the pressure surface in the turning flow path, it is possible to cool the blade surface at this moment.

As a third apparatus, a cooling structure of the first apparatus is employed, in which an air intake opening for intaking air to the cooling flow path is provided on a tip surface or a hub surface of the turbine blade so as to communicate with substantially the whole region of the first flow path.

With this invention, since the cooling air flows in the first flow path substantially uniformly, it is possible to cool the leading edge substantially equally.

As a fourth apparatus, a cooling structure of the second apparatus is employed, in which a plurality of turbulence promoters is provided along the inflow path.

With this invention, it is possible to strengthen the cooling in the inflow path due to the turbulence promoters.

As a fifth apparatus, a cooling structure of the second apparatus is employed, in which a plurality of fins or turbulence promoters, edge portions of which are connected to the suction surface and the pressure surface, is provided closer to the trailing edge than the second flow path.

With this invention, it is possible to further strengthen the cooling by making the cooling air used in the second flow path impinge on a pin before being discharged whereby it is possible to improve the cooling efficiency without wasting the cooling air.

As a sixth apparatus, a cooling structure of the second apparatus is employed, in which a proximal end of the first flow path is communicated with an outlet hole provided in the leading edge of the turbine blade.

With this invention, it is possible to additionally cool the blade surface by film cooling since it is possible to discharge the cooling air circulated in the first flow path along the blade surface from the leading edge.

As a seventh apparatus, a cooling structure of the second apparatus is employed, in which a partition portion for plurally dividing the straight flow path and the turning flow path in the height direction of the blade is provided in the straight flow path.

With this invention, it is possible to control the flow of the cooling air intending to flow in the height direction of the turbine blade in the middle of the straight flow path. Therefore, by adjusting the disposed position of the partition portion in accordance with the flow of the cooling air inside of the blade, it is possible to uniform the flow distribution of the cooling air flowing in the cooling flow path along the height direction of the turbine blade. Also, it is possible to support a load applied to the blade surface in the partition portion, whereby it is possible to increase the rigidity of the blade.

As an eighth apparatus, a cooling structure of the first apparatus is employed, in which the wall surface is the suction surface and the pressure surface of the turbine blade, the cooling flow path has the first flow path and the second flow path directing from the center portion of the turbine blade to the leading edge thereof and from the trailing edge to the center portion respectively, each of the first flow path and the second flow path has the inflow path, the straight flow path, and the turning flow path, and a trailing edge inflow path of the cooling air substantially identically shaped as the inflow path is provided closer to the trailing edge from the second flow path substantially in the same direction as the inflow path.

With this invention, it is possible to perform the cooling of the blade surface even uniformly since it is possible to use air with less temperature increase than other inventions as a cooling air for the trailing edge of the turbine blade.

As a ninth apparatus, a cooling structure of the second apparatus is employed, in which the first inflow path and the second inflow path are formed to be gradually narrowed in the height direction of the turbine blade when the inflow path of the first flow path is the first inflow path and the inflow path of the second flow path is the second inflow path so that the cooling air flowing in the first inflow path and the second inflow path flow in opposite direction with one another.

With this invention, it is possible to uniformize the cooling in the height direction of the inflow path since it is possible to maintain flow velocity as width of the flow path becomes narrower even when the cooling air, introduced to each of the inflow paths, is gradually introduced to each of the straight flow paths and the air flow rate at leading edge is gradually decreased.

As a tenth apparatus, a cooling structure of the second apparatus is employed, in which fins are set up in the middle of the turning flow path.

With this invention, it is possible to enhance the cooling performance by enlarging a heat transfer area for the cooling air flowing in the turning flow path. Also, by adjusting alignment, shape, and size of the fins, it is possible to further uniformize temperature in the blade surface.

As an eleventh apparatus, a cooling structure of the tenth apparatus is employed, in which the turbulence promoters are set up instead of the fins.

With this invention, it is possible to further enhance the cooling performance as it is possible to further strengthen the cooling in the blade surface by generating a strong turbulence in the cooling air flowing in the turning flow path.

As a twelfth apparatus, a cooling structure of the first apparatus is employed, in which the wall surface has an inner wall surface for directly contacting the high temperature combustion gas and an outer wall surface provided at the outer side of the radial direction of the turbine from the inner wall surface, and the cooling flow path is formed between the inner wall surface and the outer wall surface.

With this invention, since the cooling air circulating the straight flow path impinges on the inner wall surface and the outer wall surface in the turning flow path, it is possible to perform impingement cooling to the inner wall surface and the outer wall surface.

As a thirteenth apparatus, a cooling structure of the twelfth apparatus is employed, in which the height of the turning flow path in the outer wall surface side is higher than the height thereof in the inner wall surface side.

With this invention, it is possible to strengthen the cooling only in the inner wall surface side by increasing the flow velocity while it is possible to minimize the pressure drop of the cooling air in the outer wall surface side in which the cooling is not necessary.

As a fourteenth apparatus, a cooling structure of the first apparatus is employed, in which the wall surface is the suction surface and the pressure surface of the turbine blade, the cooling flow path has a first flow path and a second flow path directing from the center portion of the turbine blade to the leading edge thereof and to the trailing edge thereof respectively, the first flow path has at least the inflow path and the second flow path has the inflow path, the straight flow path, and the turning flow path, and the inflow paths of each of the first flow path and the second flow path are formed along the height direction of the turbine blade and are provided to be adjacent with one another.

With this invention, since the cooling air circulating in the straight flow path impinges on the suction surface or the pressure surface in the turning flow path, it is possible to cool the blade surface.

As a fifteenth apparatus, a partition portion for dividing the first flow path in the longitudinal direction of the blade is provided, and a plurality of cooling holes is formed for communicating the front space with the rear space, which are partitioned by the partition portion.

With this invention, it is possible to obtain an effect that is the same as the case in which the turning flow path is provided.

As a sixteenth apparatus, the partition portion for dividing the first flow path in the longitudinal direction of the blade is provided, and a slit is formed extending in the height direction of the blade and communicating the front space with the rear space, which are partitioned by the partition portion.

With this invention, it is possible to obtain an effect that is the same as the case in which the turning flow path is provided.

Effect of the Invention

In accordance with the present invention, it is possible to maintain and improve the cooling performance of the turbine blade without wasting the cooling air by minimizing the pressure drop of the cooling air which circulates inside of the structural body comprising the turbine.

BRIEF DESCRIPTION OF THE REFERENCE NUMERALS

Figure 1:
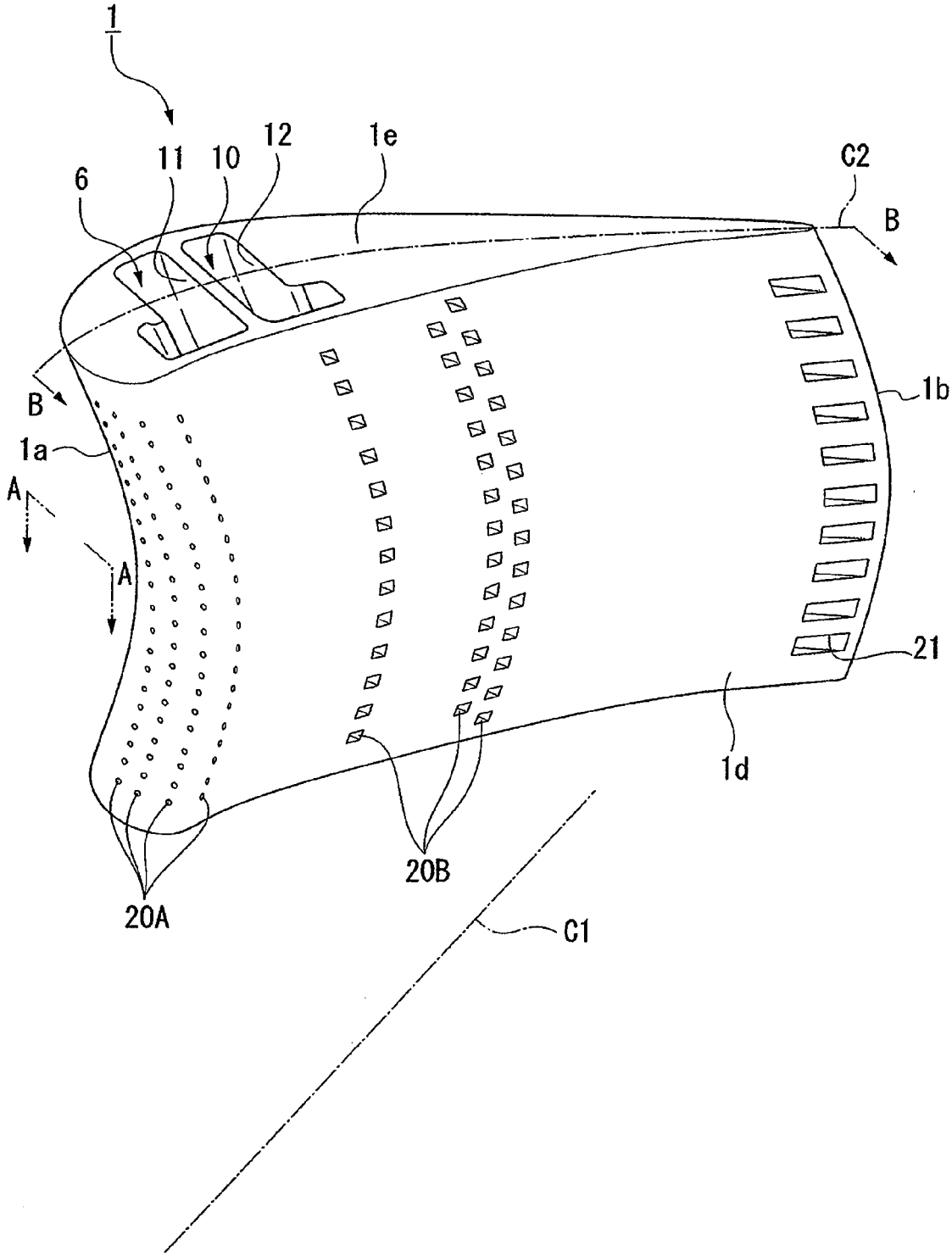
FIG. 1 is a perspective view showing a turbine blade in accordance with a first embodiment of the present invention.

1, 22, 30, 40, 50, 60, 100, 120, 130: Turbine blade (structural body)
1*a*, 30*a*, 50*a*, 100*a*, 120*a*, 130*a*: Leading edge
1*b*, 30*b*, 50*b*, 100*b*, 120*b*, 130*b*: Trailing edge
1*c*, 30*c*, 50*c*, 100*c*, 120*c*, 130*c*: suction surface (wall surface)
1*d*, 30*d*, 50*d*, 100*d*, 120*d*, 130*d*: pressure surface (wall surface)
1*e*, 30*e*, 50*e*, 100*e*, 120*e*, 130*e*: Tip surface
1*f*, 30*f*, 50*f*, 100*f*, 120*f*, 130*f*: Hub surface
2, 26, 31, 41, 51, 61, 72, 101, 121, 131: Cooling flow path
3, 42, 52, 62, 102, 122, 132: First flow path
5, 23, 32, 45, 53, 63: Second flow path
6, 43: First inflow path (Inflow path)
7, 24, 75: Slot (Straight flow path)
8, 25, 76: Turning flow path
11, 111: First intake opening (Air intake opening)
17: Pin fin (Fin)
20A: Film hole (Outlet hole)
27: Partition portion
33: Trailing edge inflow path
55: Fin
65: Turbulence promoter
71: Turbine nozzle band (Structural body)
71*a*: Inner wall surface (Wall surface)
71*b*: Outer wall surface (Wall surface)
73: Inflow path
123, 133: Leading edge portion cavity
126, 136: Partition plate (Partition portion)
127: Cooling hole
138: Slit

BEST MODE FOR CARRYING OUT THE INVENTION

Preferred embodiments of the present invention shall be described with reference to the drawings.

Figure 2A:
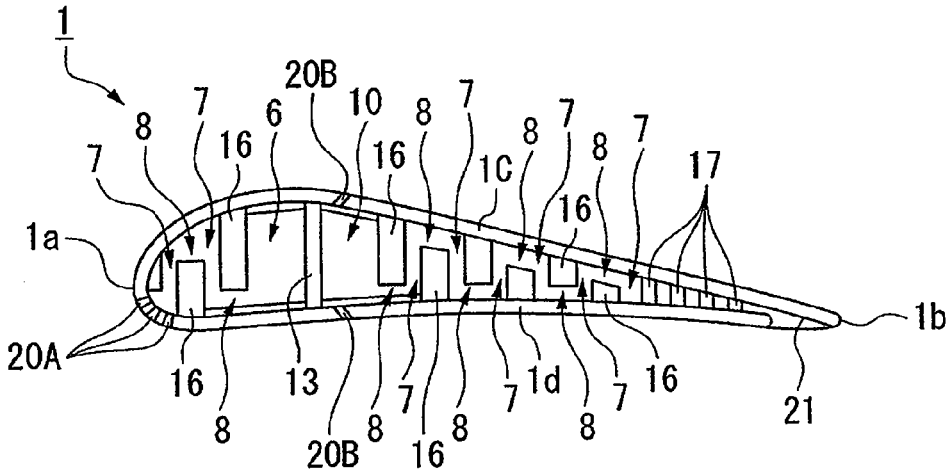
FIG. 2A is an A-A cross sectional view of FIG. 1.
Figure 2B:
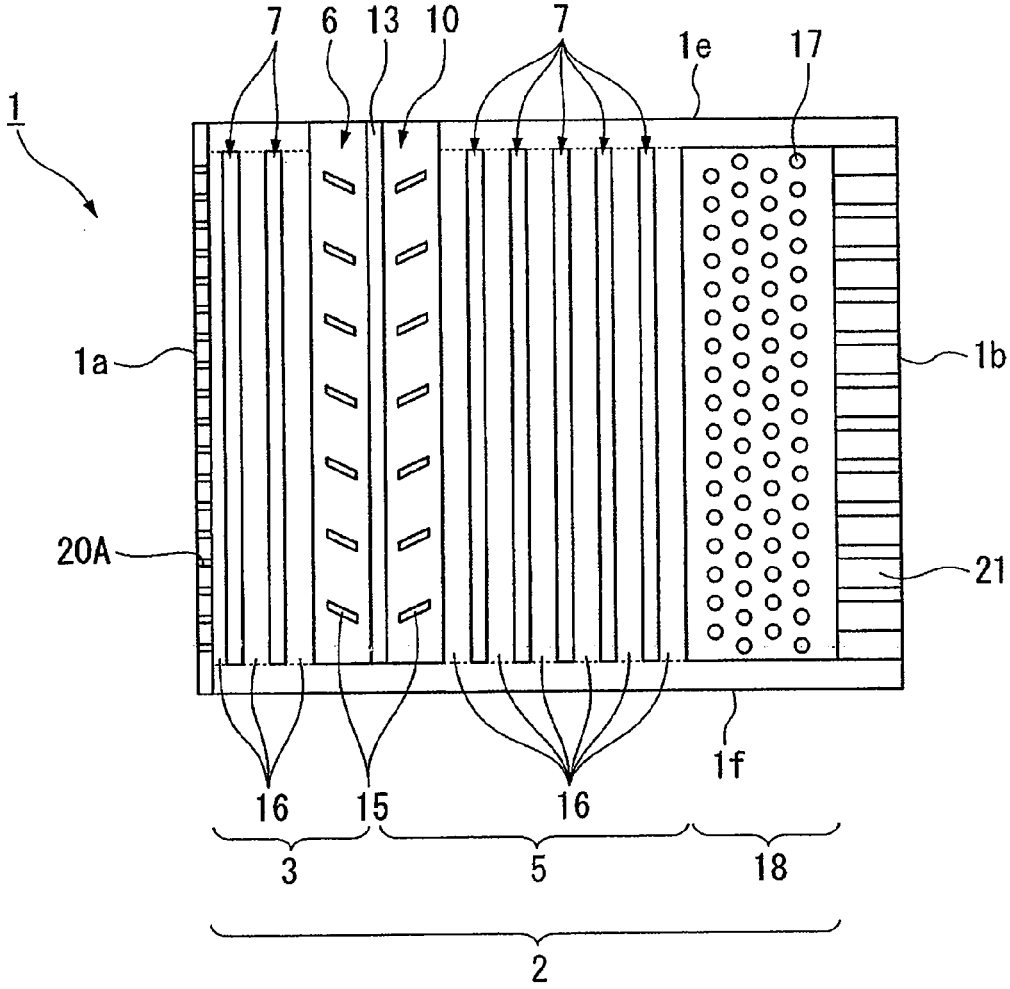
FIG. 2B is a B-B cross sectional view of FIG. 1.

A first embodiment of the present invention shall be described with reference to FIGS. 1 to 2B.

A cooling structure in accordance with the present embodiment is a cooling structure formed inside of a turbine blade 1 (structural body) so as to meander around a flow direction of a high temperature combustion gas which flows along a wall surface in substantially a turbine axial line C1 direction. The cooling structure is provided with a cooling flow path 2 in which a cooling air flows.

The turbine blade 1 is a stator vane formed as a three-dimensional bow blade which is set up in a radial direction with respect to the axial line C1. The cooling flow path 2 has a first flow path 3 and a second flow path 5 directing from the center portion of the turbine blade 1 to the leading edge 1*a* and to the trailing edge 1*b*.

The first flow path 3 has a first inflow path (inflow path) 6 for the cooling air formed inside of the turbine blade 1 so as to extend in a height direction of the turbine blade 1 which is substantially the radial direction of a turbine, a slot (straight flow path) 7 plurally provided with intervals with respect to the axial line C1 direction, in which a length substantially the same length as the first inflow path 6 is a flow path width, and extended in a direction of a suction surface (wall surface) 1*c* or a pressure surface (wall surface) 1*d*, and a turning flow path 8 in which end portions of each of the slots 7 are communicated with one after the other.

The second flow path 5 has substantially the same shape as the first flow path 6. The second flow path 5 has a second inflow path 10 extending substantially in the same direction as the first inflow path 6, a slot 7 provided in the same manner as the first flow path 3, and a turning flow path 8.

On a tip surface 1*e* of the turbine blade 1, a first intake opening 11 and a second intake opening 12 for the cooling air, which are communicated with the first inflow path 6 and the second inflow path 10 respectively, are provided. Each of the inflow paths 6 and 10 is formed toward the vicinity of the tip surface 1*e* along the height direction of the turbine blade 1 and adjacently provided interposing a partition wall 13 therebetween. In the first inflow path 6 and the second inflow path 10, turbulence promoters 15 formed in predetermined shapes are disposed in a predetermined alignment. Here, when the turbine blade 1 is a moving blade, a first inflow path 11 and a second inflow path 12 are provided on a hub surface 1*f*.

On the suction surface 1*c* and a pressure surface 1*d*, a plurality of ribs 16 are set up toward the inner portion of the blade so as to align one after the other with predetermined intervals in a direction of a center line C2 of the blade, and slots are provided between the ribs 16. The turning flow path 8 is formed between a distal end of the rib 16 and the suction surface 1*c* or a pressure surface 1*d*. A flow path width of the slot 7 and the turning flow path 8 is formed from the vicinity of the tip surface 1*e* of the turbine blade 1 to the vicinity of the hub surface 1*f*. One of these ribs 16 is also formed between a slot 7, which is closest to the first inflow path 6 and the second inflow path 10, and each of the inflow paths 6 and 10. Therefore, the slot 7, which is closest to the first inflow path 6 and the second inflow path 10, and each of the inflow paths 6 and 10 are communicated with by the turning flow path 8.

The proximal end of the second flow path 5 is communicated with a region where the suction surface 1*c* and the pressure surface 1*d* get closer. In this region, substantially cylindrical pin fins (pin) 17, end portions of which are connected to the suction surface 1*c* and the pressure surface 1*d* respectively, are provided instead of the rib 16 in a space formed by being interposed by the suction surface 1*c* and the pressure surface 1*d*, whereby a pin fin region 18, which is a part of the cooling flow path 2, is formed. The pin fins 17 are provided with a predetermined size, in a predetermined area, with predetermined intervals.

A proximal end of the first flow path 3 is communicated with a plurality of film holes (outlet hole) 20A provided in the leading edge 1*a* of the turbine blade. The pin fin region 18 is communicated with a plurality of slot cooling holes 21 provided in the trailing edge 1*b* of the turbine blade 1. Here a plurality of film holes 20B, which is communicated with the turning flow path 8, is provided in the suction surface 1*c* and the pressure surface 1*d*.

Next, an operation of the cooling structure of the turbine blade 1 in accordance with the present invention shall be described.

Air introduced from a compressor (not shown) is mixed with fuel in a combustor (not shown), becomes a high temperature combustion gas by being combusted, impinges the leading edge 1*a* of the turbine blade 1, and flows to the trailing edge 1*b* along the suction surface 1*c* or the pressure surface 1*d*. On the other hand, a part of the air is introduced into the first inflow path 6 and the second inflow path 10 from the first intake opening 11 and the second intake opening 12 respectively as a cooling air for the turbine blade 1 without being mixed with each other.

The cooling air flowing in each of the inflow paths 6 and 10 gradually flows into the turning flow path 8 by flowing toward the hub surface 1*f* and strengthening the cooling in the turbulence promoters 15. By meandering between the turning flow path 8 and the slot 7, the cooling air flows toward the proximal ends of each of the flow paths. At this moment, when the cooling air flows to the turning flow path 8 from the slot 7, by the cooling air impinging on the suction surface 1*c* or the pressure surface 1*d*, each of the blade surfaces are performed impingement cooling. Also, heat is exchanged between the ribs 16, thereby cooling the blade 1.

Here, when the width of the slot 7 is shorter than the height of the turning flow path 8, since the flow path is narrowed by the slot 7, the pressure drop at the slot 7 becomes great but the pressure drop at the turning flow path 8 is basically small. Also, since the flow velocity of the cooling air increases at the slot 7, the impingement velocity of the cooling air to the suction surface 1*c* and the pressure surface 1*d* becomes high.

The cooling air flowed in the first flow path 3 is discharged to the outside of the blade from the film hole 20*a* of the leading edge 1*a*. The discharged air flows along the suction surface 1*c* and the pressure surface 1*d* and cools each of the blade surfaces from the outside as well. On the other hand, the cooling air flowed in the second flow path 5 flows into the pin fin region 18 provided with the pin fins 17 form the slot 7 and the turning flow path 8. When the cooling air flows in the pin fin region 18 impinging on the lateral side of the pin fins 17, heat is exchanged between the pin fins 17 and the cooling is performed. Then the cooling air is discharged to the outside of the blade from the slot cooling holes 21.

In accordance with the cooling structure, it is possible to maintain and enhance the cooling performance while not wasting the cooling air by restraining the pressure drop of the cooling air which circulates the inside of the turbine blade 1. Especially, when the cooling air impinging on the suction surface 1*c* and the pressure surface 1*d*, it is also possible to increase the flow velocity at the slot 7 and to perform the impingement cooling at the blade surface more effectively in this case.

Since the cooling air is separately introduced to the first flow path 3 and the second flow path 5, the cooling air flowing in the first flow path 3 and the cooling air flowing second flow path 5 do not mix, and so it is possible to prevent the cooling air which cooled the leading edge 1*a* from heading to the trailing edge 1*b*, whereby it is possible to increase the cooling efficiency in the trailing edge 1*b*. Furthermore, by introducing the cooling air to the first inflow path 6 and the second inflow path 10 passing the turbulence promoters 15 provided in each of the inflow paths 6 and 10, it is possible to strengthen the cooling in the first flow path 6 and the second flow path 10.

Also, by colliding the cooling air used in the second flow path 5 with the pin fins 17 before being discharged to the outside of the blade, it is possible to further strengthen the cooling, and so it is possible to enhance the cooling efficiency while not wasting the cooling air. Also, since it is possible to discharge the cooling air circulating the first flow path 3 from the leading edge 1*a* along the blade surface, it is possible to cool the blade outside surface by film cooling.

Figure 3A:
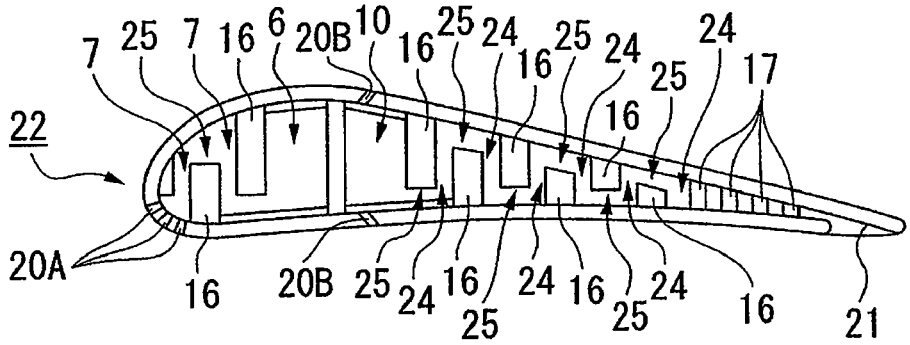
FIG. 3A shows a turbine blade in accordance with a second embodiment of the present invention corresponding to the location of the A-A cross section of FIG. 1.
Figure 3B:
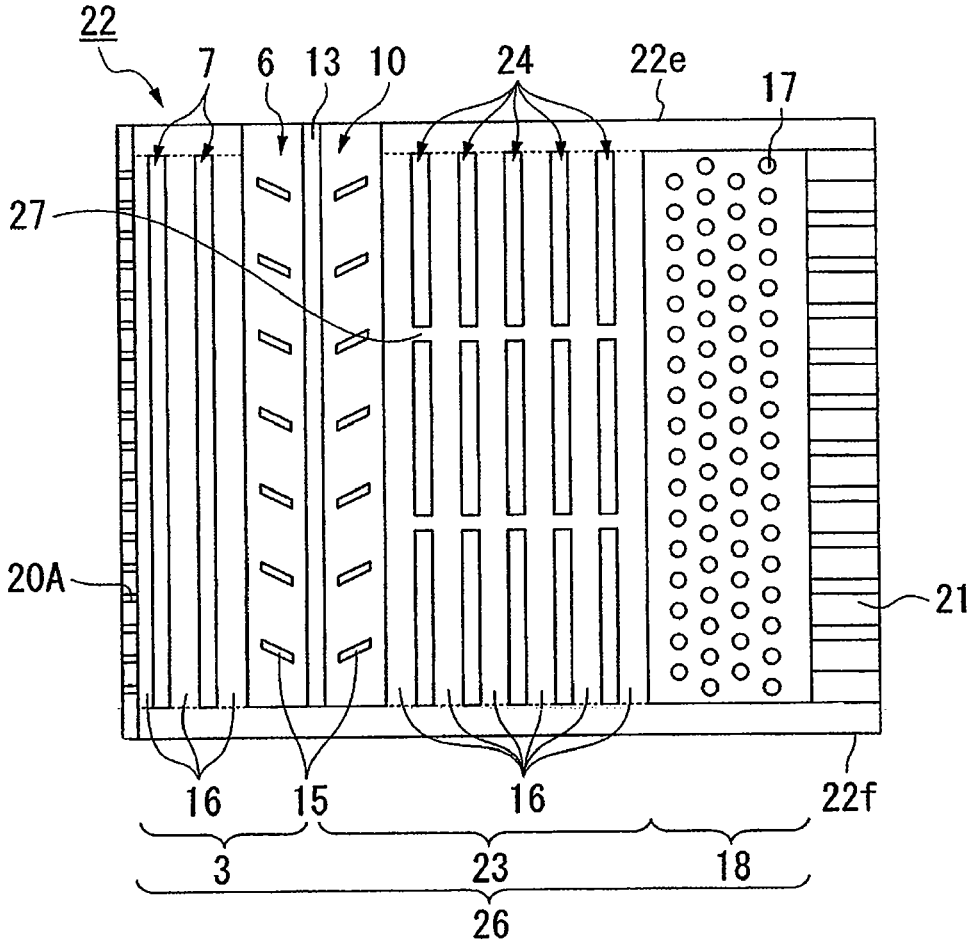
FIG. 3B shows a turbine blade in accordance with the second embodiment of the present invention corresponding to the location of the B-B cross section of FIG. 1.
Figure 3C:
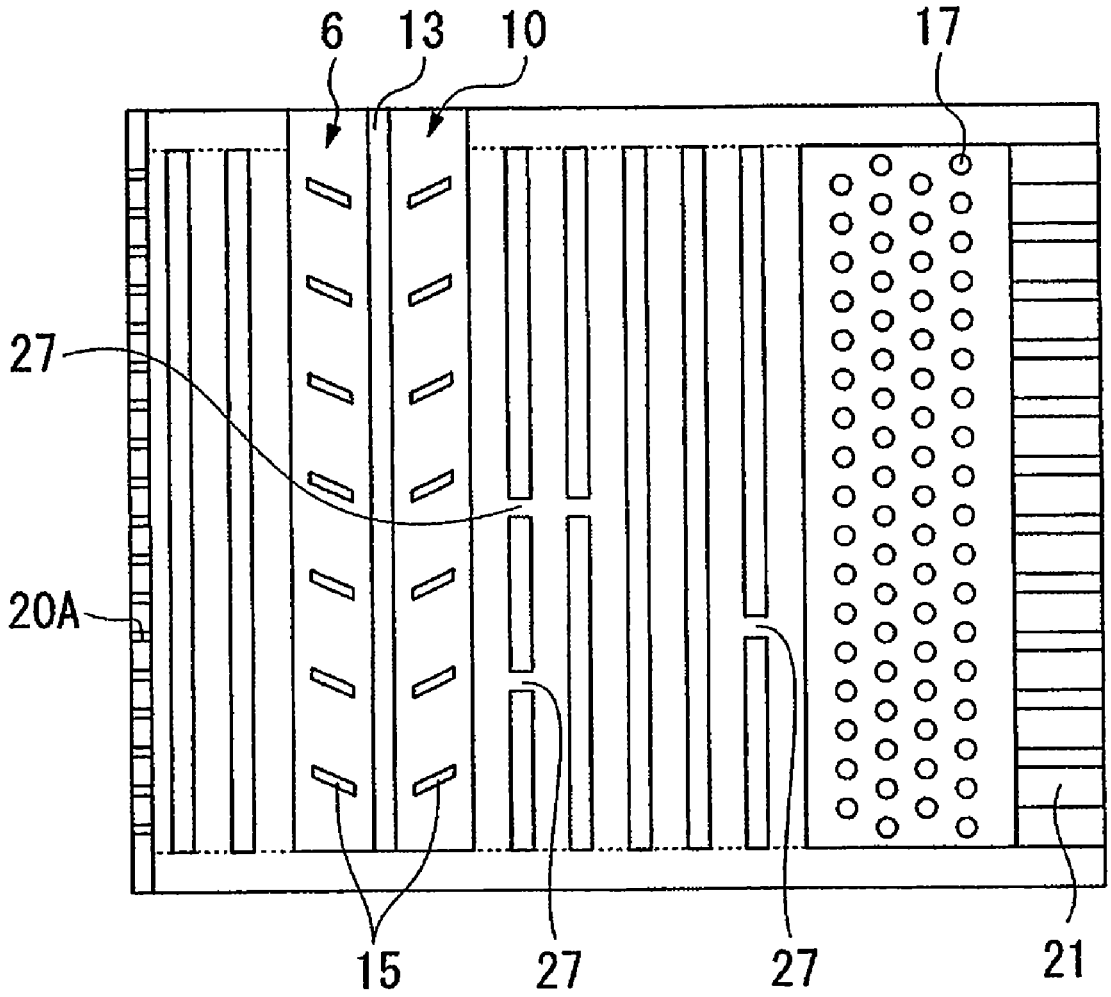
FIG. 3C shows an alternative example of the turbine blade in accordance with the second embodiment of the present invention.

Next, a second embodiment of the present invention shall be described with reference to FIGS. 3A to 3C. Note that in the description, the same reference numbers shall be given to identical portions and descriptions of overlapping portions shall be omitted.

The difference between the second embodiment and the first embodiment is that a partition portion 27, which plurally partitions a slot 24 and a turning flow path 25 of a second flow path 23 in the blade height direction in a cooling flow path 26 with predetermined intervals, is provided as a cooling structure of a turbine blade 22 in accordance with the present embodiment.

The partition portion 27 is a plate shape for example and is provided so as to align in a direction of a center line C2 of the turbine blade 22. Here, as shown in FIG. 3C, the partition portion 27 may be provided partly in portions in which the partition portion 27 is necessary.

Next, an operation of the cooling structure of the turbine blade 22 in accordance with the present invention shall be described.

As in the first embodiment, the cooling air of the turbine blade 22, which is respectively introduced into the first inflow path 6 and the second inflow path 10 from the first intake opening 11 and the second intake opening 12 of a tip surface 22*e*, gradually flows into the turning flow path 25 as the cooling air flows closer to a hub surface 22*f* while passing the turbulence promoters 15.

Then the cooling air flows toward a proximal end of the first flow path 3 and the second flow path 23 while meandering between the turning flow path 25 and the slot 24. At this moment, since the partition portion 27 is provided in the slot 24 and the turning flow path 25, even when the cooling air intends to flow toward the height direction of the turbine blade 22 in the slot 24 and the turning flow path 25, that is, a width direction of the flow path, the flow is prevented by the partition portion 27. Therefore, the flow distribution in the height direction of the blade is further uniformized, and the cooling air flows toward the proximal end of each of the flow paths. In this period, the heat exchange identical to the first embodiment is performed, and the cooling air is discharged to the outside of the blade from the film holes 20A and the slot holes 21.

In accordance with the cooling structure of the turbine blade 22, by adjusting the alignment positions of the partition portions 27 in accordance with the flow of the cooling air inside of the blade, it is possible to further uniformize the flow distribution of the cooling air, which flows in the cooling flow path 26, in the height direction of the turbine blade 22. Also, since it is possible to support a load, which applies to the blade surface, with the partition portions 27, it is possible to increase the rigidity of the blade.

Figure 4A:
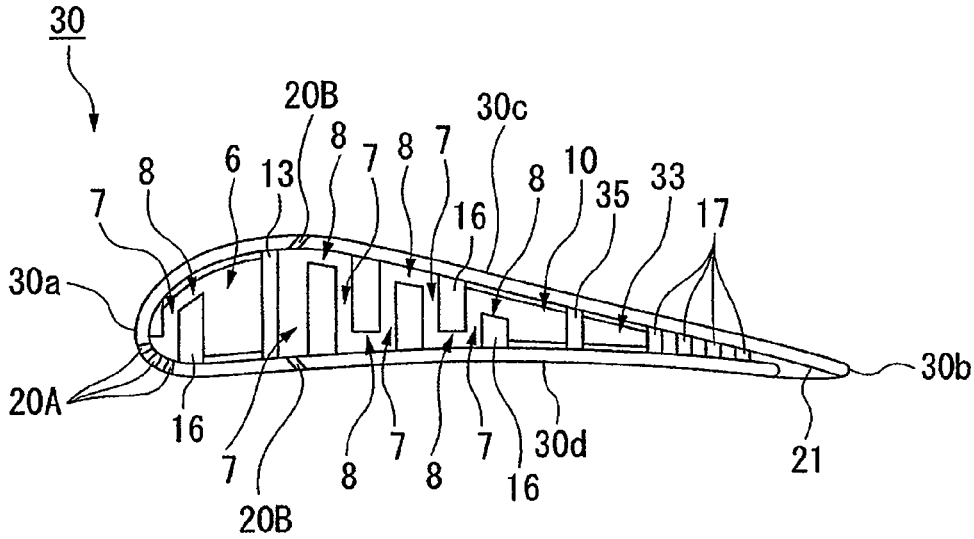
FIG. 4A shows a turbine blade in accordance with a third embodiment of the present invention corresponding to the location of the A-A cross section of FIG. 1.
Figure 4B:
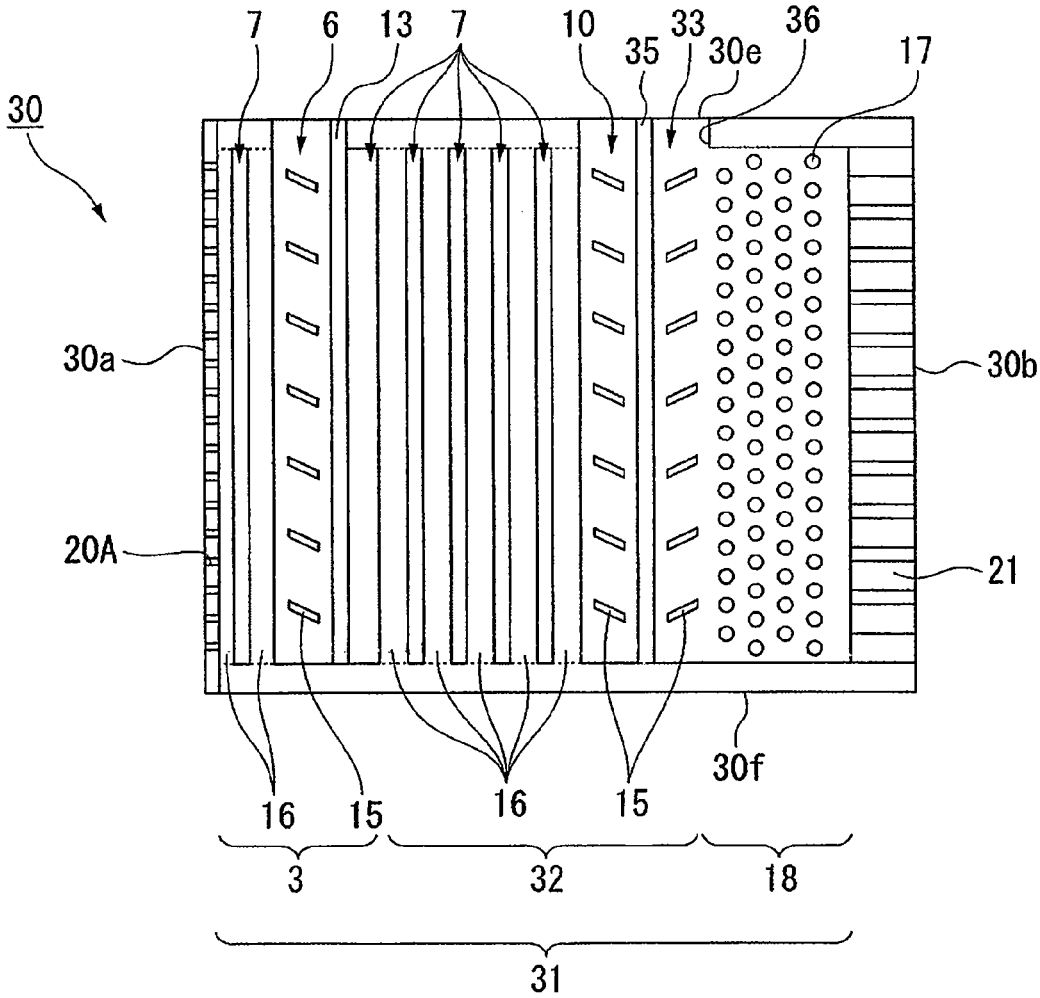
FIG. 4B shows a turbine blade in accordance with a third embodiment of the present invention corresponding to the location of the B-B cross section of FIG. 1.

Next, a third embodiment of the present invention shall be described with reference to FIGS. 4A to 4B. Note that in the description, the same reference numbers shall be given to identical portions and descriptions of overlapping portions shall be omitted. The difference between the third embodiment and the first embodiment is that a second flow path 32 of a cooling flow path 31 of a turbine blade 30 in accordance with the present embodiment, is formed so that the cooling air flows from a trailing edge 30*b* of the turbine blade 30 to the center portion, and a trailing edge inflow path 33, for supplying the cooling air to the pin fin region 18, is provided in the trailing edge side than the second flow path 32.

The second inflow path 10 is adjacent to the leading edge 30*a* side from the pin fin region 18 apart from the first inflow path 6, which is different from the first embodiment. A proximal end of the second flow path 32 is communicated with the film holes 20B provided in a suction surface 30*c* and a pressure surface 30*d* in the vicinity of the first inflow path 6.

The trailing edge inflow path 33 is formed substantially the same shape as each of the inflow paths 6 and 10 and is provided to be extended substantially in the same direction. The second inflow path 10 and the trailing edge inflow path 33 are provided to be adjacent interposing a partition wall therebetween. On a tip surface 30*e* of the turbine blade 30, a trailing edge intake opening 36 of the cooling air, which communicates with the trailing edge inflow path 33, is formed. The turbulence promoters 15 are provided in the trailing edge inflow path 33 as well.

Next, an operation of the cooling structure of the turbine blade 30 in accordance with the present invention shall be described.

As in the first embodiment, the cooling air is introduced into the first inflow path 6, the second inflow path 10, and the trailing edge inflow path 33 respectively from the first intake opening 11, the second intake opening 12, and the trailing edge intake opening 36. The cooling air, which is introduced into the first flow path 3 and the second flow path 32, gradually flows into the turning flow path 8 while impinging on the turbulence promoters 15 and flowing toward a hub surface 30*f*.

In this moment, the turbine 30 is cooled in the first flow path 3 in accordance with the same operation as the first embodiment. In the second flow path 32, the cooling air flows toward the leading edge 30*a* from the trailing edge 30*b* of the turbine blade 30. The operation at this moment is the same as the first embodiment. Here, the cooling air is not flown to the pin fin region 18 but is discharged to the outside of the blade from the film holes 20B, which are provided on the suction surface 30*c* and the pressure surface 30*d* in the vicinity of the first inflow path 6.

The cooling air introduced into the trailing edge inflow path 33 gradually flows into the pin fin region 18 while passing the turbulence promoters 15 and flowing toward the hub surface 30*f*. In the pin fin region 18, the cooling air flows, while impinging on the lateral sides of the pin fins 17, performs the same heat exchange as the first embodiment, and the cooling air is discharged to the outside of the blade from the slot cooling holes 21.

In accordance with the cooling structure of the turbine blade 30, by circulating the cooling air in the slot 7 and the turning flow path 8, the air, which is not badly influenced such as the pressure drop or the temperature being increased, is introduced into the trailing edge inflow path 33. Therefore, it is possible to use the air with a relatively low temperature and a small pressure drop as the cooling air of the trailing edge of the turbine blade 30, so it is possible to perform the cooling on the blade surface even more uniformly.

Figure 5A:
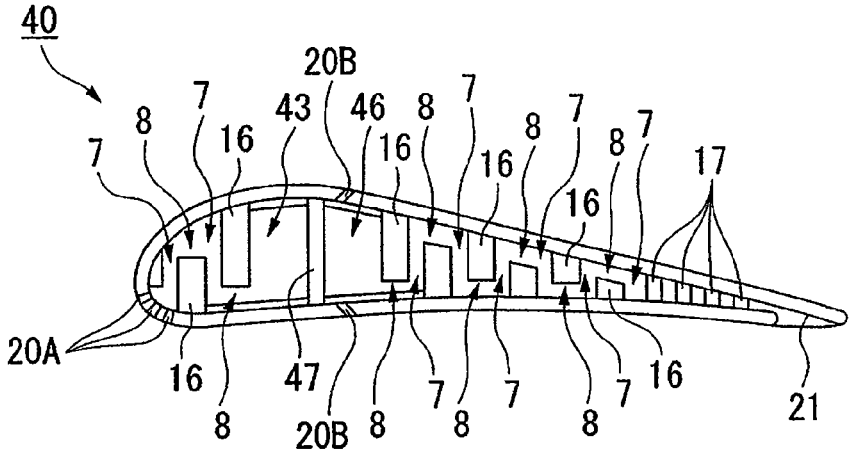
FIG. 5A shows a turbine blade in accordance with a fourth embodiment of the present invention corresponding to the location of the A-A cross section of FIG. 1.
Figure 5B:
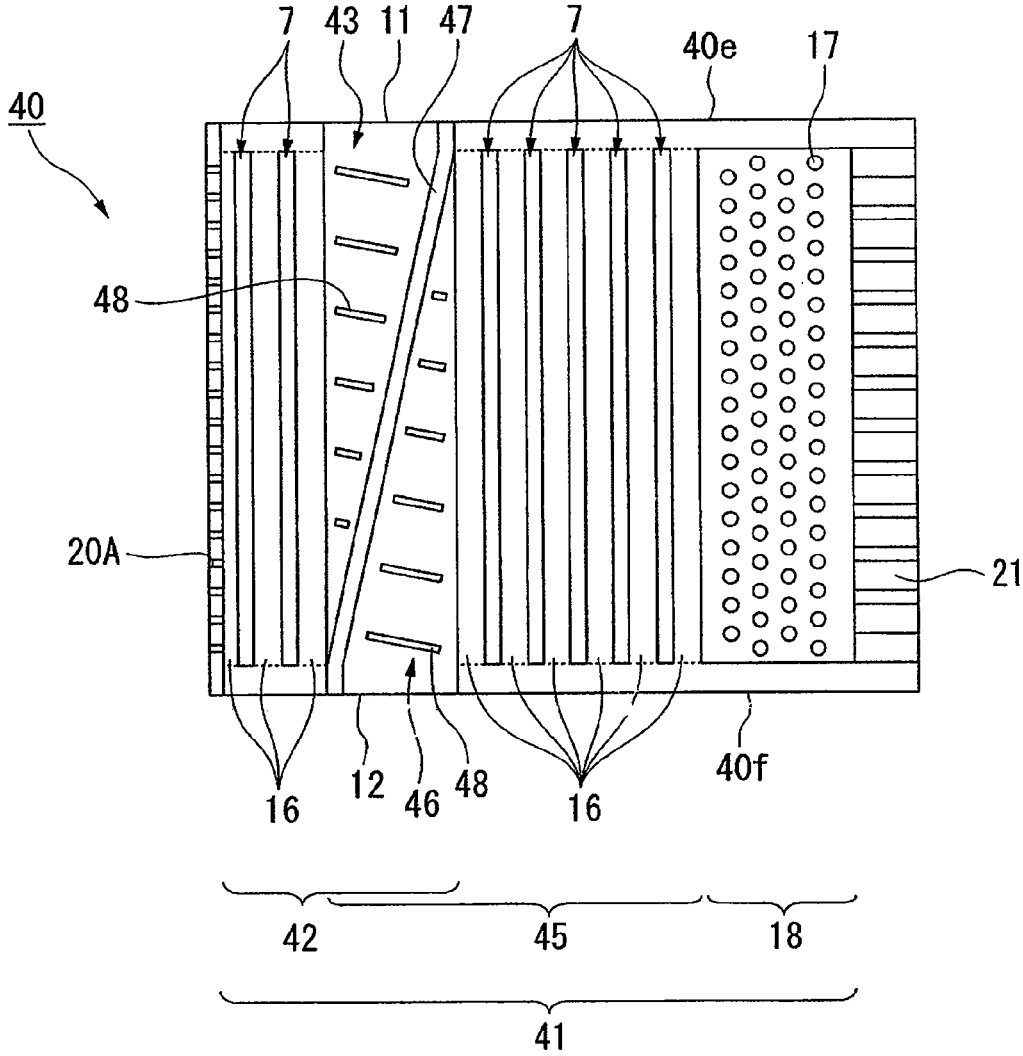
FIG. 5B shows a turbine blade in accordance with a fourth embodiment of the present invention corresponding to the location of the B-B cross section of FIG. 1.

Next, a fourth embodiment of the present invention shall be described with reference to FIGS. 5A to 5B. Note that in the description, the same reference numbers shall be given to identical portions and descriptions of overlapping portions shall be omitted.

The difference between the fourth embodiment and the first embodiment is that a first inflow path 43 of a first flow path 42 and a second inflow path 46 of a second flow path 45 of a cooling flow path 41 of a turbine blade 40 in accordance with the present embodiment are formed to be gradually narrowed in the height direction of the turbine blade 40 so that the cooling air, which flows in the first inflow path 43 and the second inflow path 46, face each other.

The first intake opening 11, which is communicated with the first inflow path 43, is provided on a tip surface 40*e* of the turbine blade 40, and the second intake opening communicated with the second intake opening 46 is provided on a hub surface 40*f* of the turbine blade 40. A partition wall 47 is provided so as to be inclined with respect to the rib 16 so that a total flow path width of the first inflow path 43 and the second inflow path 46 is formed so as to be substantially the same size at an arbitral location in the height direction of the blade. The turbulence promoters 15, which are provided in the first inflow path 43 and the second inflow path 46, are formed in accordance with the width of the flow path. Here, the first intake opening 11 may be provided on the hub surface 40*f* and the second intake opening 12 may be provided on the tip surface 40*e*.

Next, an operation of the cooling structure of the turbine blade 40 in accordance with the present invention shall be described.

A part of the air introduced from the compressor (not shown) is introduced, as the cooling air for the turbine blade 40, from the first intake opening 11 and the second intake opening 12 respectively into the first inflow path 43 and the second inflow path 46 without being mixed with each other.

The cooling air, which flows in the first inflow path 43, gradually flows into the turning flow path 8 while passing the turbulence promoters 15 and flowing toward the hub surface 40*f*. At this moment, since the flow path is narrowed, the flow velocity is maintained even when the flow in the first inflow path 43 gets closer to the hub surface 40*f* and the flow rate of the cooling air gradually decreases.

The cooling air, which flows in the second inflow path 46, gradually flows into the turning flow path 8 while passing the turbulence promoters 15 and flowing toward the tip surface 40*e*. At this moment, since the flow path is narrowed to be the same as the first inflow path 43, the flow velocity is maintained even when the flow in the second flow path 46 gets closer to the tip surface 40*e* and the flow rate of the cooling air gradually decreases.

With the flow velocity maintained, the cooling air flows into the turning flow path 8 and flows toward the proximal end by meandering between the turning flow path 8 and the slot 7 with substantially the same flow velocity on the tip surface 40*e* and the hub surface 40*f*. At this moment, the same heat exchange is performed as the first embodiment, and the cooling air is discharged to the outside of the blade.

In accordance with the cooling structure of the turbine blade 40, when the cooling air, which is introduced to each of the inflow paths 43 and 46, passes each of the inflow paths 43 and 46, since it is possible to maintain the flow velocity and to uniformize the cooling performance on the tip surface 40*e* and the hub surface 40*f*.

Figure 6A:
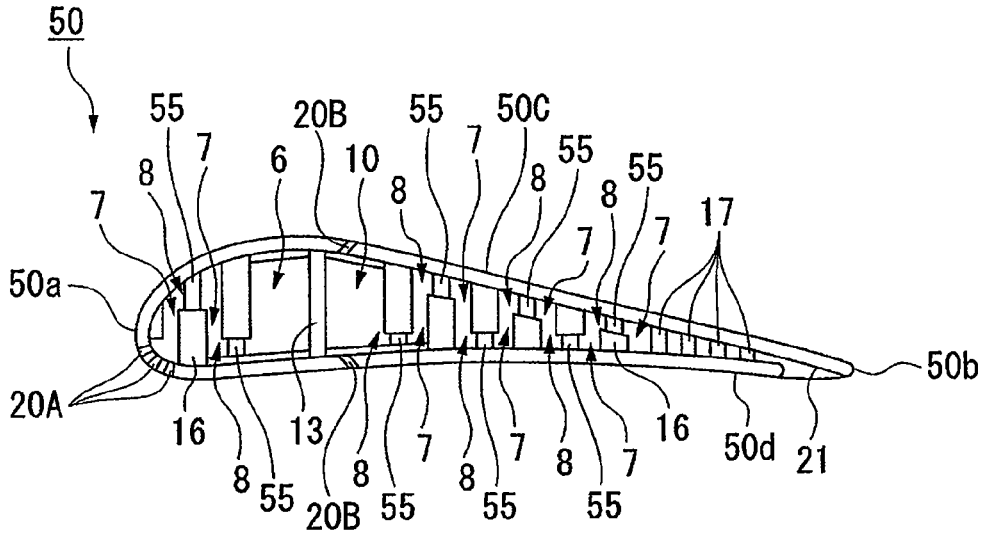
FIG. 6A shows a turbine blade in accordance with a fifth embodiment of the present invention corresponding to the location of the A-A cross section of FIG. 1.
Figure 6B:
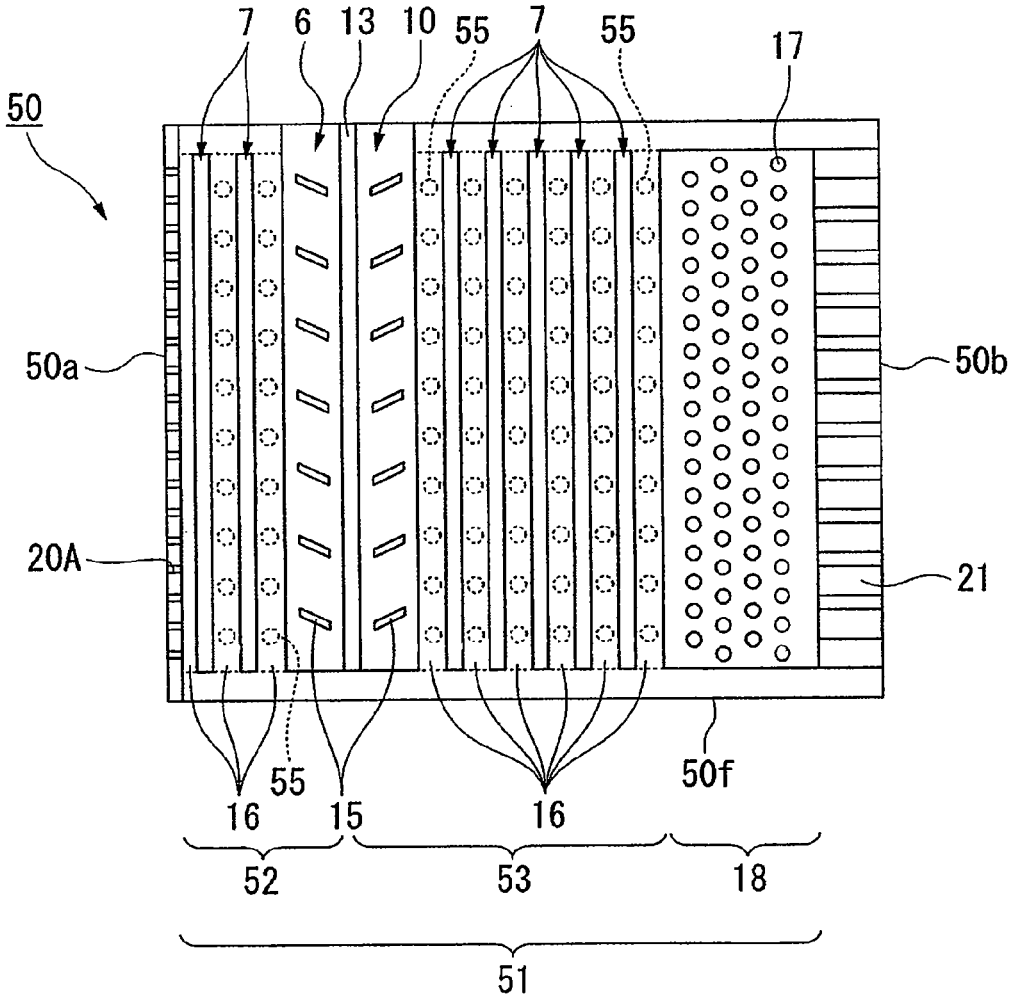
FIG. 6B shows a turbine blade in accordance with a fifth embodiment of the present invention corresponding to the location of the B-B cross section of FIG. 1.

Next, a fifth embodiment of the present invention shall be described with reference to FIGS. 6A to 6B. Note that in the description, the same reference numbers shall be given to identical portions and descriptions of overlapping portions shall be omitted.

The difference between the fifth embodiment and the first embodiment is that fins 55 are set up in the middle of each of the turning flow paths 8 of a first flow path 52 and a second flow path 53 of a cooling flow path 51 of a turbine blade 50 in accordance with the present embodiment.

The fins 55 are formed to be substantially a cylindrical shape so as to connect a distal end of the ribs 16 and a suction surface 50*c* or a pressure surface 50*d*. The fins are provided in each of the turning flow paths 8 so as to be aligned along a center line C2 from a leading edge 50*a* to a trailing edge 50*b*. Here, the shape, the size, and the alignment of the fins 55 are not limited to this but the fins can be provided intensively in places where the cooling is necessary.

Next, an operation of the cooling structure of the turbine blade 50 in accordance with the present invention shall be described.

As in the first embodiment, the cooling air for the turbine blade 50, which is introduced into the first inflow path 6 and the second inflow paths 10 respectively from the first intake opening 11 and the second intake opening 12, gradually flows into the turning flow path 8 while impinging on turbulence promoters 15 and flowing to the hub surface 50*f*.

Then, the cooling air flows toward the proximal end of each of the first flow path 52 and the second flow path 53 while meandering between the turning flow path 8 and the slot 7. At this moment, since the fins 55 are set up in the turning path 8, when the cooling air flows while impinging on lateral sides of the fins 55, the heat exchange is performed between the fins 55 and the cooling is performed. In this manner, the same heat exchanged as the first embodiment is performed, then the cooling air is discharged to the outside of the blade from the film hole 20A and the slot cooling hole 21.

In accordance with the cooling structure of the turbine blade 50, since it is possible to flow the cooling air along the fins 55 in the turning flow path 8, it is possible to enhance the cooling performance by enlarging the heat transfer area of the cooling air flowing in the turning flow path 8. By adjusting the alignment, the shape, and the size of the fins 55, it is possible to further uniformize the temperature on the blade surface.

Figure 7A:
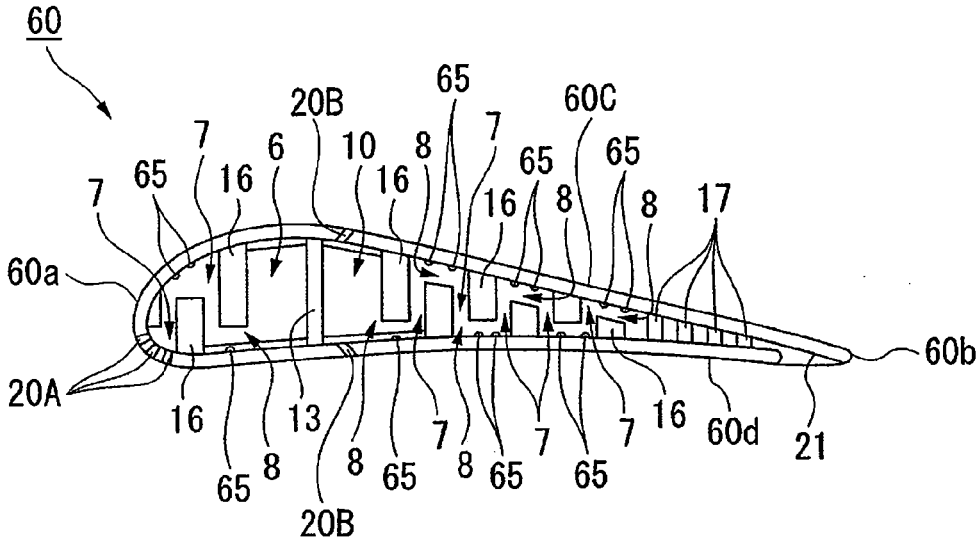
FIG. 7A shows a turbine blade in accordance with a sixth embodiment of the present invention corresponding to the location of the A-A cross section of FIG. 1.
Figure 7B:
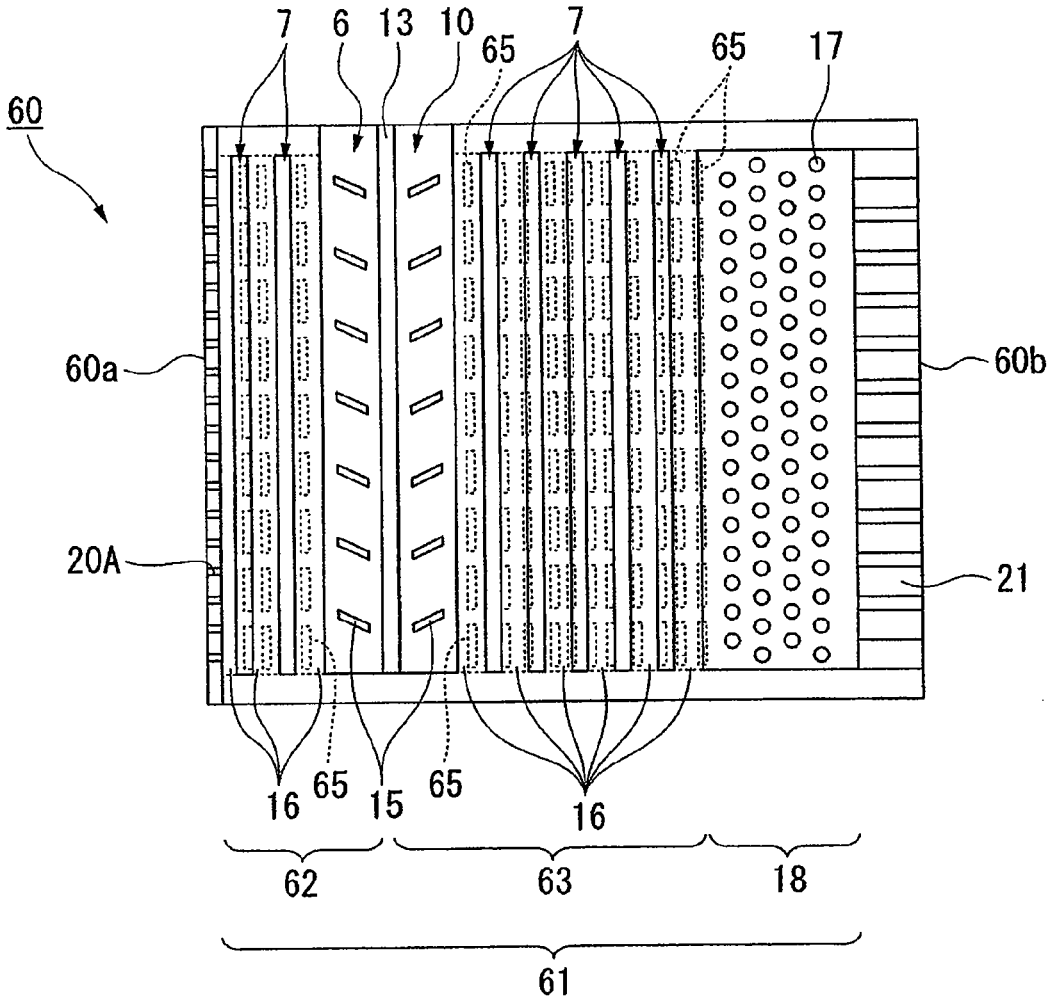
FIG. 7B shows a turbine blade in accordance with a sixth embodiment of the present invention corresponding to the location of the A-A cross section of FIG. 1.

Next, a sixth embodiment of the present invention shall be described with reference to FIGS. 7A to 7B. Note that in the description, the same reference numbers shall be given to identical portions and descriptions of overlapping portions shall be omitted. The difference between the sixth embodiment and the fifth embodiment is that turbulence promoters 15 are provided in the turning flow path 8 of a first flow path 62 and a second flow path 63 of the cooling flow path 61 of a turbine blade 60 in accordance with the present embodiment.

The turbulence promoters 65 are formed so that spaces are formed between the distal ends of the ribs 16 and each of suction surface 60*c* and the pressure surface 60*d*. As in the fins 55 in the fifth embodiment, the turbulence promoters 65 are provided so as to be aligned along the center line C2 from a leading edge 60*a* to a trailing edge 60*b*. Here, the shape, the size, and the alignment of the turbulence promoters 65 are not limited to this but they may be provided intensively in a place where the cooling is necessary.

The cooling structure in accordance with the present embodiment can obtain the same effect as the cooling structure of the turbine blade 50 in accordance with the fifth embodiment.

Figure 8:
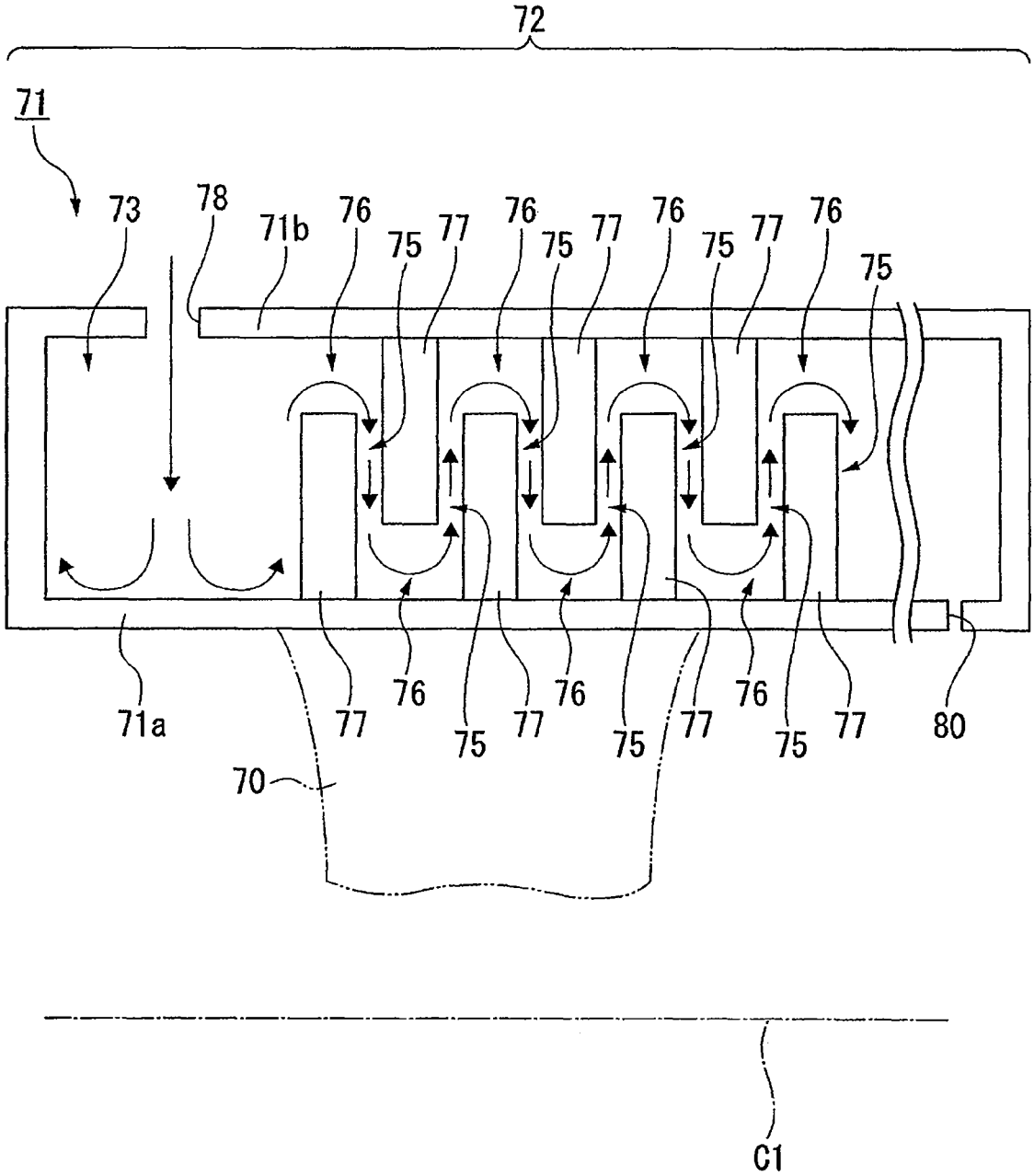
FIG. 8 is a cross sectional view showing a turbine nozzle band in accordance with a seventh embodiment of the present invention.

Next, a seventh embodiment of the present invention shall be described with reference to FIG. 8. Note that in the description, the same reference numbers shall be given to identical portions and descriptions of overlapping portions shall be omitted.

The difference between the seventh embodiment and the other embodiments is that the cooling structure in accordance with the present embodiment is not the turbine blade but a cooling flow path 72 formed in a turbine nozzle band 71, in which a turbine blade 70 is set up.

The turbine nozzle band 71 is provided with an inner wall surface (wall surface) 71*a* provided in the inner side in the radial direction of the turbine and an outer wall surface (wall surface) 71*b* provided in the outer side in the radial direction of the turbine from the inner wall surface 71*a*. The cooling flow path 72 is formed between the inner wall surface 71*a* and the outer wall surface 71*b*.

The cooling flow path 72 is provided with an inflow path 73 formed along a circumferential direction of the turbine nozzle band 71, slots 5, a flow width of which is substantially the same length as the inflow path 73 formed so as to extend between the inner wall surface 71*a* and the outer wall surface 71*b* substantially in perpendicular direction from the inner wall surface 71*a* and the outer wall surface 71*b*, and a turning flow path 76 communicating with end portions of the slots 75 one after the other.

The slots 75 and the turning flow path 76 are formed by ribs 77 which are set up from the inner wall surface 71*a* or the outer wall surface 71*b*. On the outer wall surface 71*b*, hole or slit intake opening 78 is provided and communicates with the inflow path 73. On the inner wall surface 71*a* which is a proximal end of the cooling flow path 72, an outlet cooling hole 80 is provided. Here, the height of the turning flow path 76 on the outer wall surface 71*b* is higher than the height of the turning flow path 76 on the inner wall surface 71*a*.

Next, an operation of the cooling structure of the turbine nozzle blade 71 in accordance with the present invention shall be described.

The air introduced from the compressor (not shown) is mixed with fuel in the combustor (not shown) and combusted to be a high temperature combustion gas, and flows along the blade surface of the turbine blade 70 and the inner diameter side of the inner wall surface 71*a* of the turbine nozzle band 71. On the other hand, a part of the air introduced from the compressor is introduced into the inflow path 73 from the intake opening 78 as the cooling air for the turbine nozzle band 71, and performs impingement cooling on the inner wall surface 71*a*.

The cooling air, which flows in the inflow path 73, gradually flows into the turning flow path 76 while flowing toward the inner wall surface 71*a* from the outer wall surface 71*b*. Then, the cooling air flows toward the axial line C1 direction while meandering between the turning flow path 76 and the slots 75. At this moment, as in the first embodiment, the cooling air flows into the turning flow path 76 from the slots 75, the cooling air impinges on the inner wall surface 71*a* and the outer wall surface 71*b*, and then impingement cooling is performed on the wall surface. Heat is exchanged between the ribs 77 and the cooling is performed. In this manner, the cooling air is discharged from the outlet cooling hole 80 of the inner wall surface 71*a*, and is returned to a mainstream of the high temperature combustion gas.

In accordance with the cooling structure of the turbine nozzle band 71, the flow path is narrowed at the slots 75, and the cooling air circulating the slots 75 impinges on the inner wall surface 71*a* or the outer wall surface 71*b* with high velocity, it is possible to perform impingement cooling even preferably on the inner wall surface 71*a* or the outer wall surface 71*b*.

Figure 9:
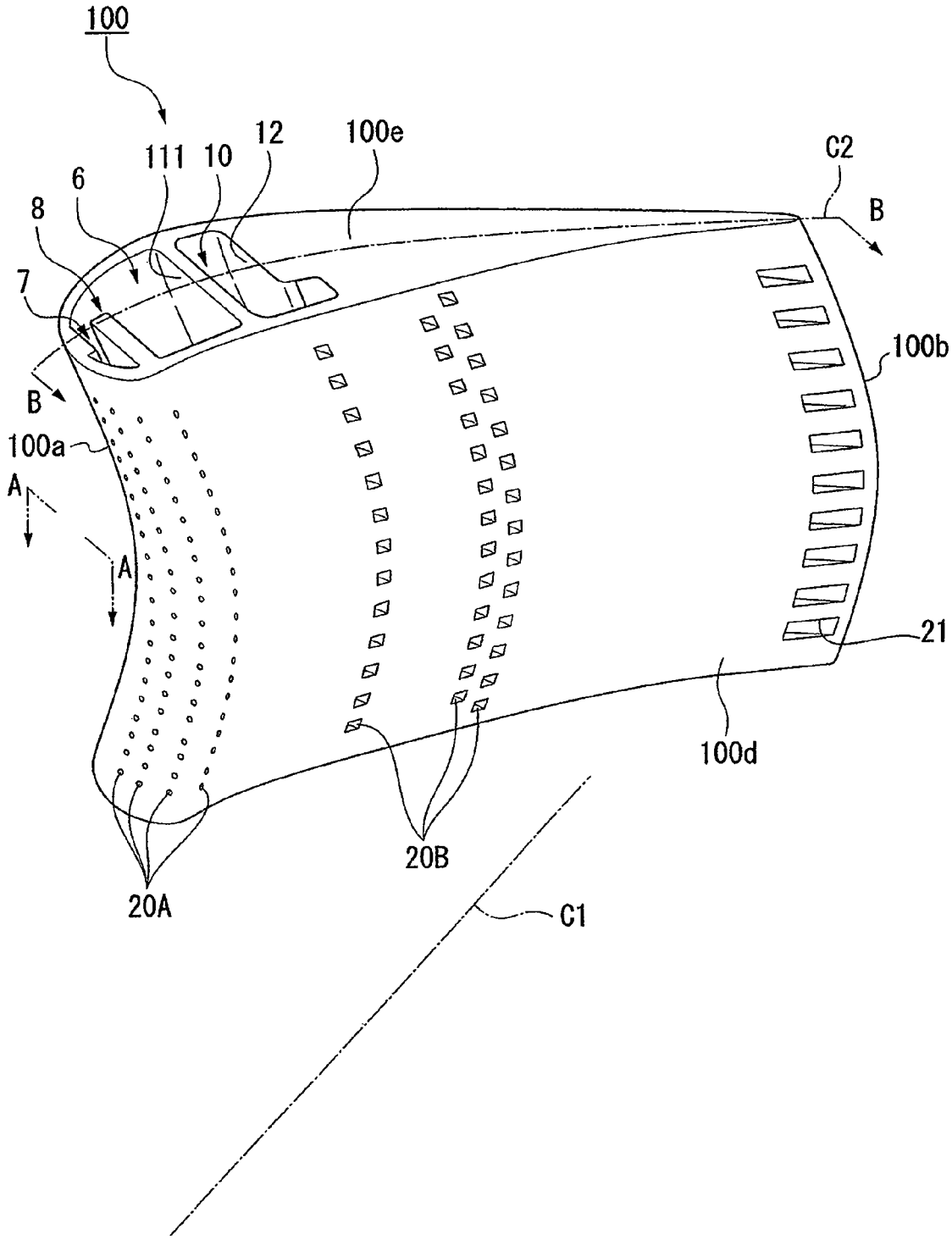
FIG. 9 is a view showing a simulation result of a flow of a cooling air in a turbine blade 1 in accordance with an eighth embodiment of the present invention.
Figure 10A:
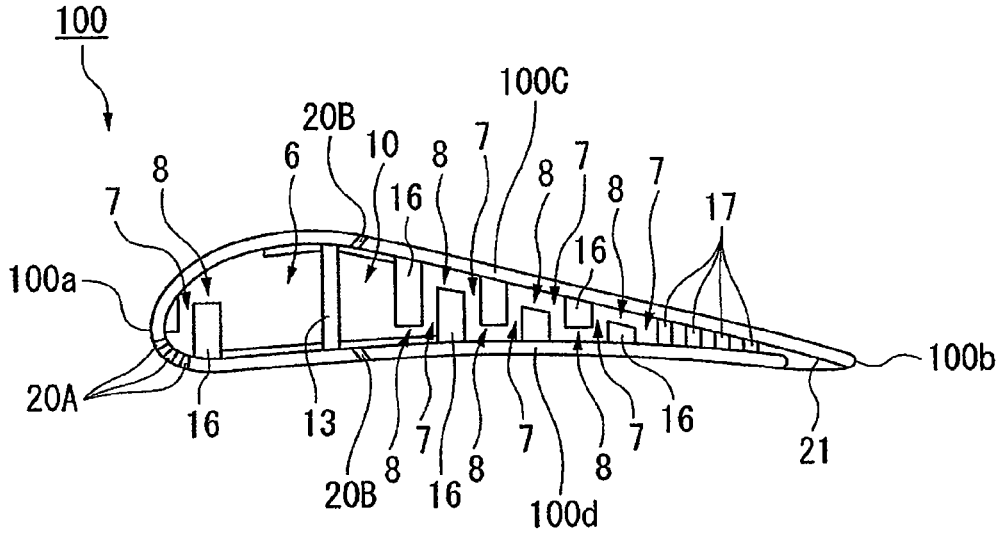
FIG. 10A is an A-A cross sectional view of FIG. 9.
Figure 10B:
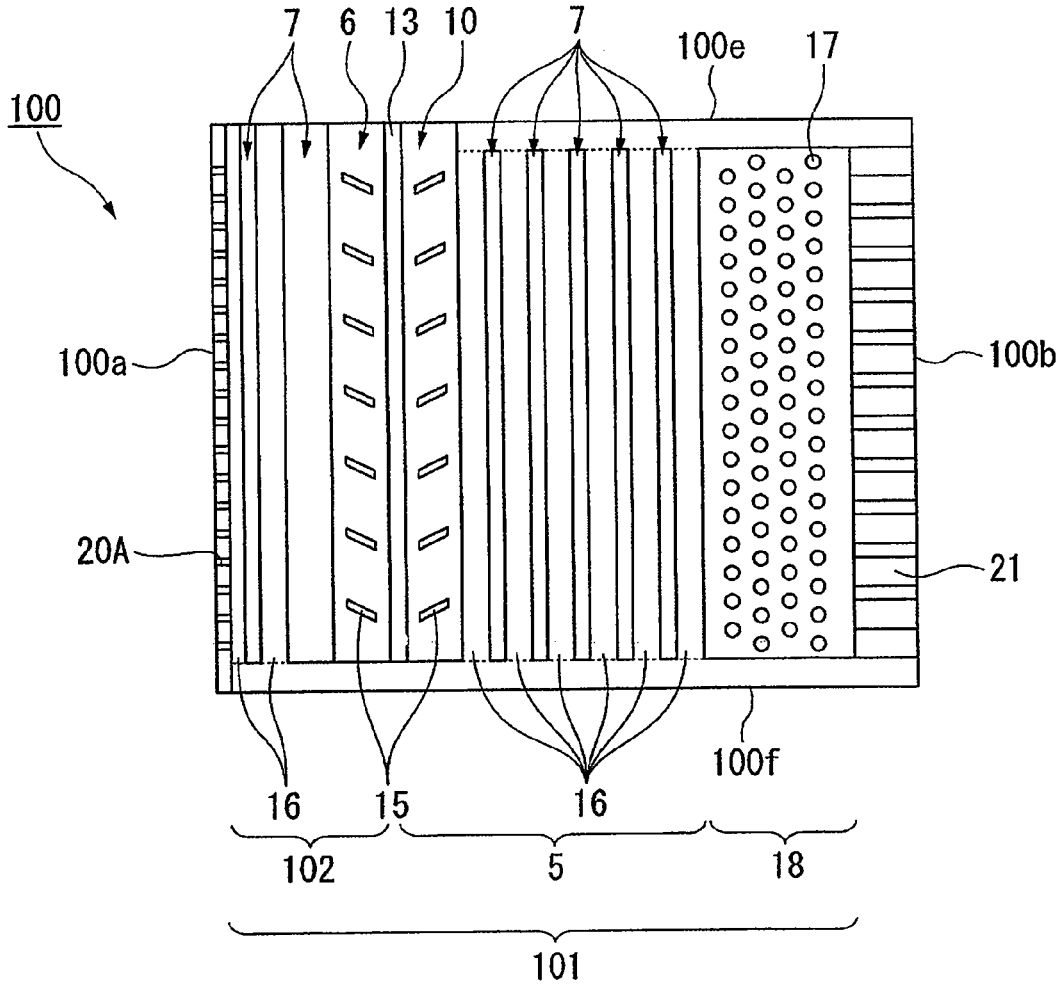
FIG. 10B is a B-B cross sectional view of FIG. 9.

Next, an eighth embodiment of the present invention shall be described with reference to FIGS. 9 and 10. Note that in the description, the same reference numbers shall be given to identical portions and descriptions of overlapping portions shall be omitted.

The difference between the eighth embodiment and the first embodiment is that a first intake opening 111 of the cooling air formed on a tip surface 100*e* of a turbine blade 100 is formed so as to largely open on a leading edge 100*a* side. That is, the first intake opening 111 is formed so as to communicate not only with the first inflow path 6 but also with the slots 7 and the turning flow paths 8.

Also, although a first flow path 102 is the same as the first embodiment in that it is provided with a first inflow path 6, a slot 7, and a turning flow path 8, it is different in that it is provided with a single set of the slot 7 and the turning flow path 8.

In this manner, the reason for enlarging the opening area of the intake opening 111 of the cooling air formed on the tip surface 10*e*, decreasing the number of the slots 7 and the turning flow paths 8 of the first flow path 102 is for circulating the cooling air flowing into the first flow path 102 onto the whole surface of the leading edge 100*a* substantially uniformly, and cooling the leading edge 100*a* substantially uniformly.

In the case of the turbine blade 1 of the first embodiment, the cooling air flows into the first flow path 102 from the first intake opening 111 which is formed on the tip surface 100*e*. Most of that cooling air flows swiftly toward the hub surface 100*f*. Accordingly, an extreme static pressure drop is created in the vicinity of the leading edge 100*a* of the first intake opening 111, a stagnation of the cooling air is created on the tip surface 100*e* of the leading edge 100*a*, therefore the cooling of the tip surface 1*e* of the leading edge 100*a* becomes insufficient, or in an even worse case, the high temperature mainstream gas counterflows into the cooling flow path, whereby it might cause a break in the turbine blade.

Therefore, in the turbine blade 100, by enlarging the opening area of the first intake opening 111 of the cooling air formed on the tip surface 100*e*, and decreasing the number of slots 7 and the turning flow paths 8 of the first flow path 102, a rapid pressure drop in the leading edge 100*a* of the first intake opening 111 is prevented from occurring.

Accordingly, an extreme static pressure drop is prevented from happening in the first flow path 102, the cooling air circulates the whole surface of the leading edge 100*a* substantially uniformly. Therefore, the whole portion from the tip surface 100*e* to the hub surface 100*f* of the leading edge 100*a* is cooled substantially uniformly. As a result of this, it is possible to reduce the cooling air.

In this manner, it is possible to realize a low pressure drop by enlarging the opening area of the intake opening 111 for the cooling air. Furthermore, since it prevents a local low static pressure region from being created, it is possible to assure the pressure difference between inside and outside of the turbine blade 100, therefore the high temperature mainstream gas does not counterflow into the inside of the turbine blade 100. As a result of this, since it is possible to flow more cooling air, it is possible to enhance the cooling performance, and the turbine blade can resist a high temperature mainstream gas.

Here, in the case of the turbine blade being a moving blade, the first intake opening 111 and the second intake opening 12 are provided on the hub surface 100*f*.

Figure 11:
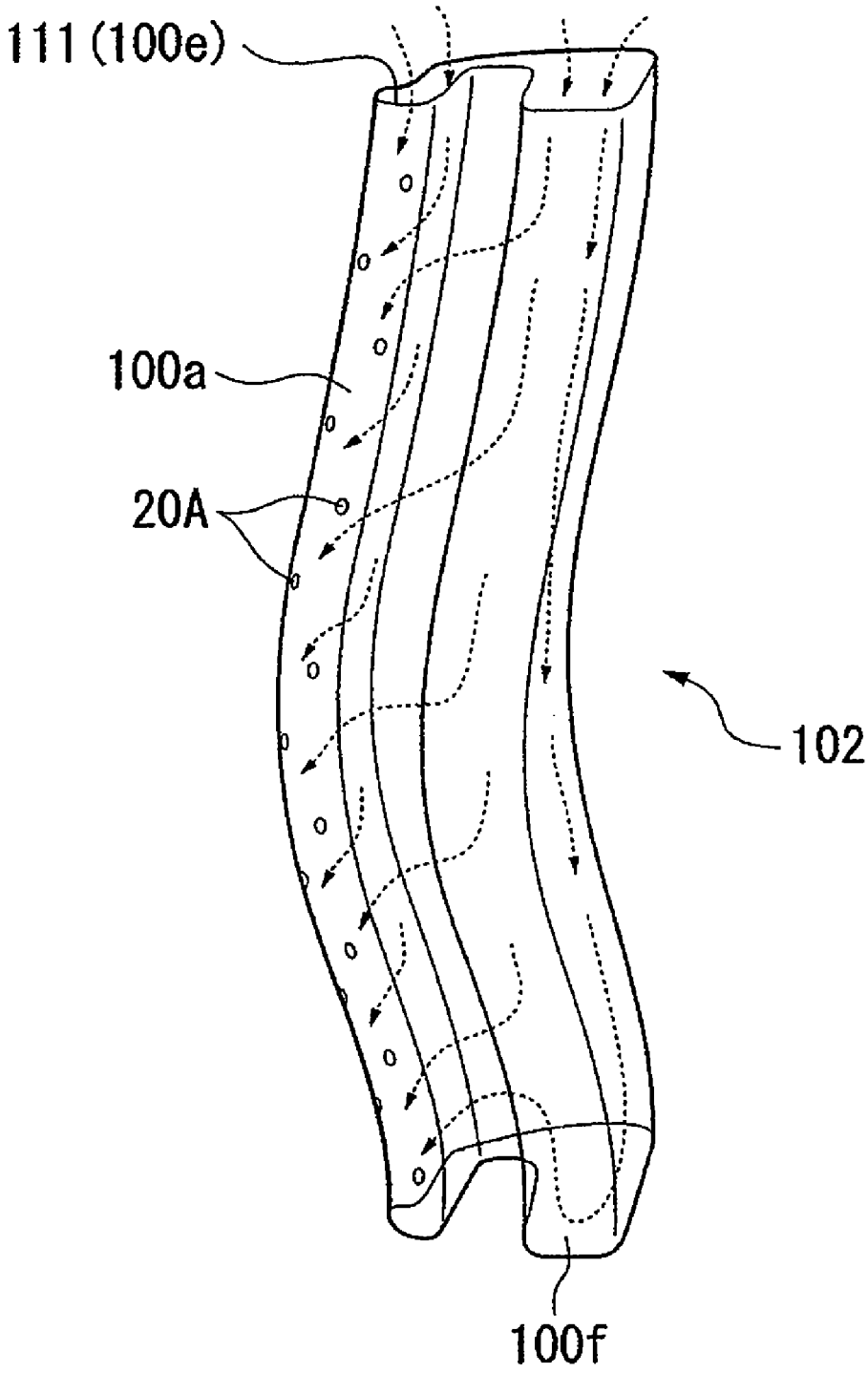
FIG. 11 shows a simulation result (a schematic view showing a flow field of the cooling air in a first flow path) of the cooling air in the turbine blade in accordance with an eighth embodiment of the present invention.
Figure 12:
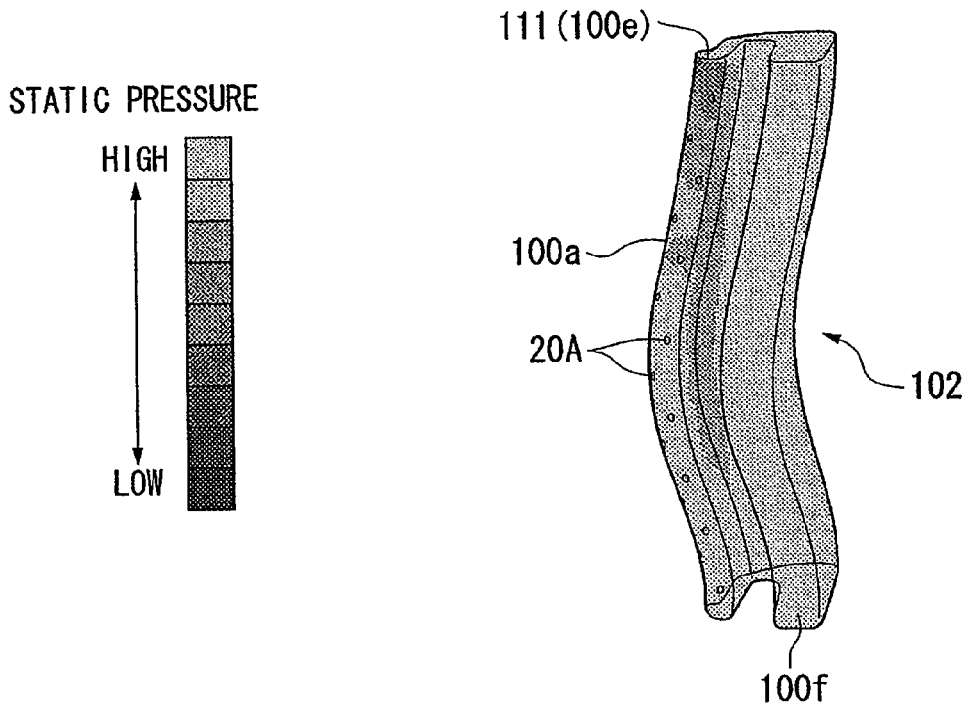
FIG. 12 shows a simulation result (a static pressure distribution in the first flow path) of the cooling air in the turbine blade in accordance with an eighth embodiment of the present invention.
Figure 13:
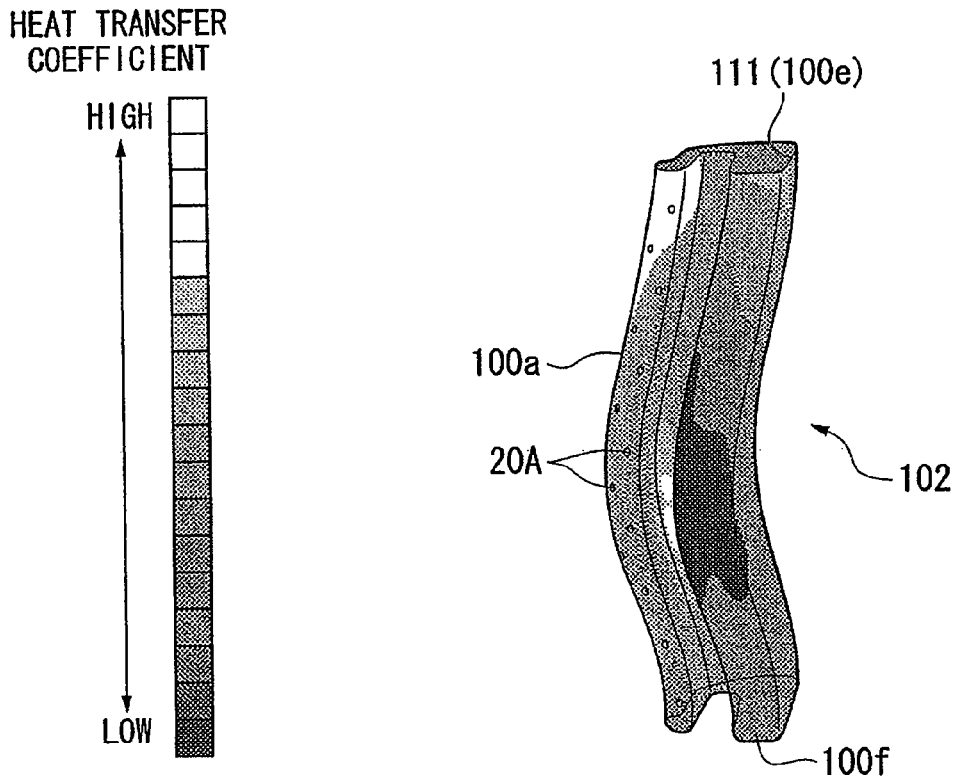
FIG. 13 shows a simulation result (a heat transfer rate distribution in the first flow path) of the cooling air in the turbine blade in accordance with an eighth embodiment of the present invention.

FIGS. 11 to 13 show a simulation result of the cooling air in the turbine blade 100 in accordance with the eighth embodiment. FIG. 11 shows a schematic diagram of flow field of the cooling air in the first flow path 102. FIG. 12 shows a static pressure distribution in the first flow path 102. FIG. 13 shows a heat transfer coefficient distribution in the first flow path 102.

As shown in FIG. 11, in the turbine blade 100 of the eighth embodiment, the cooling air flown into the first flow path 102 from the first intake opening 111 formed on the tip surface 10*e* flows substantially uniformly toward the hub surface 100*f* from the tip surface 100*e* of the leading edge 100*a*, and no stagnation seems to be created.

As shown in FIG. 12, in the turbine blade 100 of the eighth embodiment, the heat transfer coefficient distribution is substantially uniform in the first flow path 102, without any local low static pressure region being created.

As shown in FIG. 13, in the turbine blade 100 of the eighth embodiment, a substantially uniform heat transfer coefficient distribution can be obtained from the tip surface 100*e* of the leading edge 100*a* toward the hub surface 100*f*. Since the heat transfer coefficient is substantially identical from the tip surface 100*e* of the leading edge 100*a* to the hub surface 100*f*, the leading edge 100*a* is cooled substantially uniformly along the whole surface thereof.

In this manner, in accordance with the turbine blade 100 of the eighth embodiment, no stagnation is created in the flow of the cooling air flown into the first flow path 102; and the leading edge 100*a* is cooled substantially uniformly along the whole surface thereof.

Figure 14A:
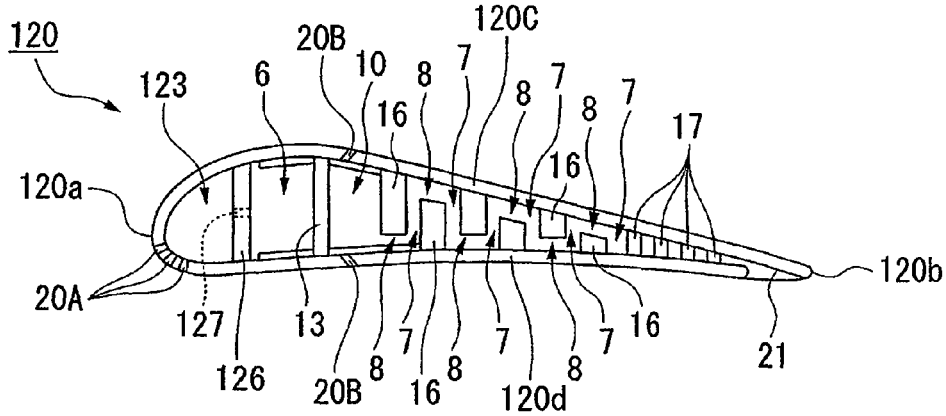
FIG. 14A shows a turbine blade in accordance with a ninth embodiment of the present invention corresponding to the location of the A-A cross section of FIG. 1.
Figure 14B:
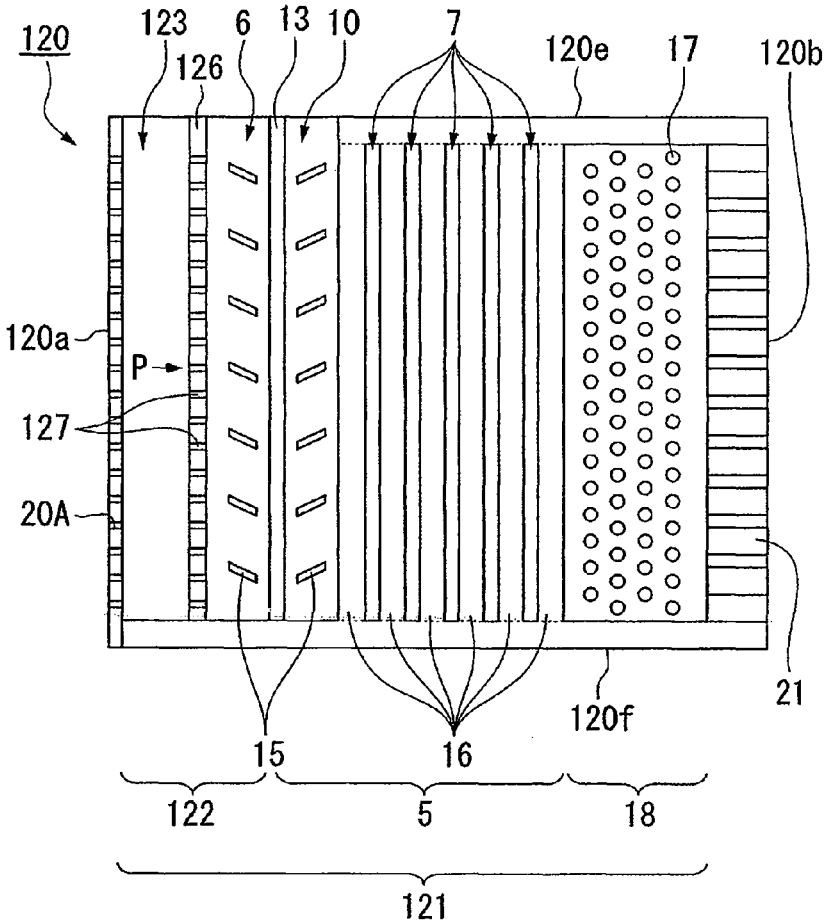
FIG. 14B shows a turbine blade in accordance with a ninth embodiment of the present invention corresponding to the location of the B-B cross section of FIG. 1.
Figure 14C:
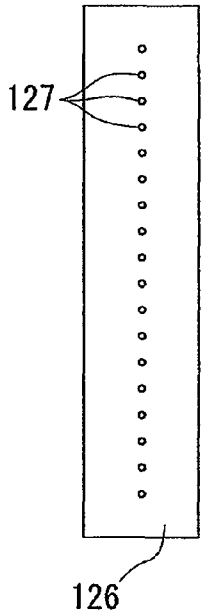
FIG. 14C shows a turbine blade in accordance with a ninth embodiment of the present invention seen from an arrow P in FIG. 14B.

Next, a ninth embodiment of the present invention shall be described with reference to FIGS. 14A to 14C. Note that in the description, the same reference numbers shall be given to identical portions and descriptions of overlapping portions shall be omitted.

The difference between the ninth embodiment and the eighth embodiment is that in a first flow path 122 of a cooling path 121 of a turbine blade 120 in accordance with the present embodiment, a partition plate 126, which is set up substantially in parallel to the partition wall 13, for partitioning the first flow path 122 into two spaces (the first inflow path 6 and a leading edge portion cavity 123) is provided. In the partition plate 126, a plurality of cooling holes 127 is formed to be aligned in a line (refer to FIG. 14C).

Here, the first intake opening 111 for the cooling air formed on a tip surface 120*e* of the turbine blade 120 is largely opened to a leading edge 120*a*, which is the same as the eighth embodiment.

Next, an operation of the cooling structure of the turbine blade 120 in accordance with the present invention shall be described.

As in the eighth embodiment, the cooling air introduced into the first inflow path 6 from the first intake opening 111 gradually flows toward the leading edge portion cavity 123 from the plurality of cooling holes 127 formed in the partition plate 126. At this moment, when the cooling air impinges on the inner wall of the leading edge portion cavity 123, the heat is exchanged between the inner wall of the leading edge portion cavity 123 and the cooling is performed. After the heat exchange is performed, the cooling air is discharged from the film holes 20A and the slot cooling holes 21 to the outside of the blade.

As in the eighth embodiment, since the cooling air also flows into the leading edge portion cavity 123 from the first intake opening 111, on the tip surface 120*e* of the leading edge 120*a*, no stagnation of the cooling air is created. Accordingly, it is possible to obtain a substantially uniform heat transfer coefficient distribution from the tip surface 120*e* of the leading edge 120*a* to the hub surface 120*f*. Therefore, substantially the whole surface of the leading edge 120*a* is cooled substantially uniformly.

Figure 15A:
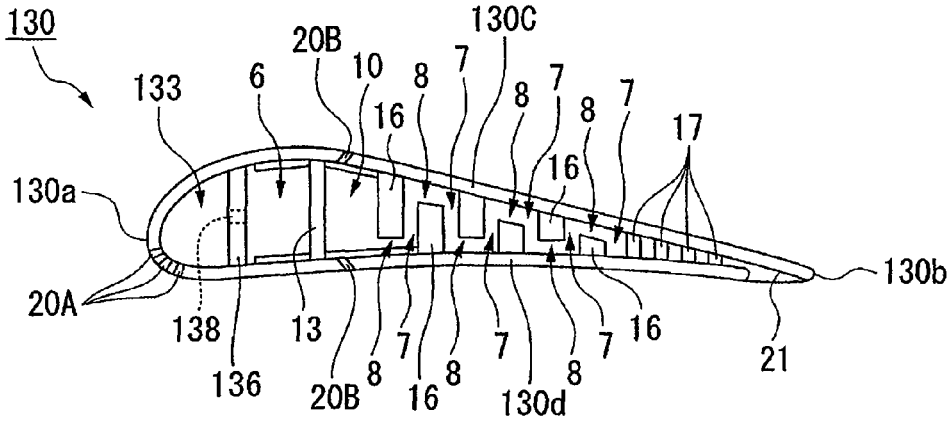
FIG. 15A shows a turbine blade in accordance with a tenth embodiment of the present invention corresponding to the location of the A-A cross section of FIG. 1.
Figure 15B:
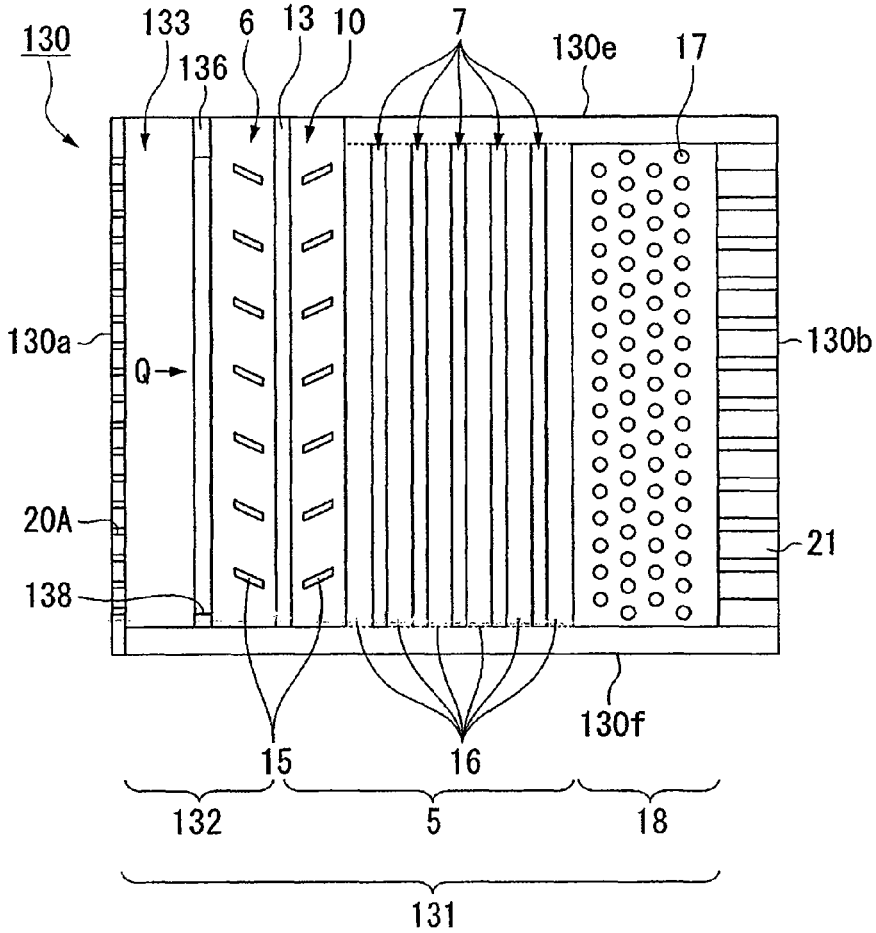
FIG. 15B shows a turbine blade in accordance with a tenth embodiment of the present invention corresponding to the location of the B-B cross section of FIG. 1.
Figure 15C:
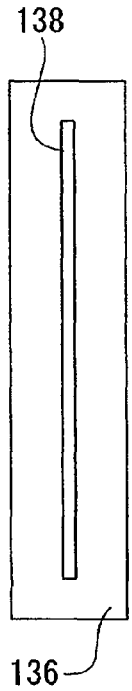
FIG. 15C shows a turbine blade in accordance with a tenth embodiment of the present invention seen from an arrow Q in FIG. 15B.

Next, a tenth embodiment of the present invention shall be described with reference to FIGS. 15A to 15C. Note that in the description, the same reference numbers shall be given to identical portions and descriptions of overlapping portions shall be omitted.

The difference between the tenth embodiment and the ninth embodiment is that in a first flow path 132 of a cooling path 131 of a turbine blade 130 in accordance with the present embodiment, a partition plate 136, which is set up substantially in parallel to the partition wall 13, for partitioning the first flow path 132 into two spaces (the first inflow path 6 and a leading edge portion cavity 133) is provided. In the partition plate 136, a slit 138 is formed from a tip surface 130*e* to a hub surface 130*f* (refer to FIG. 15C).

Here, the first intake opening 111 for the cooling air formed on a tip surface 130*e* of the turbine blade 130 is largely opened to a leading edge 130*a*, which is the same as the eighth and ninth embodiments.

Next, an operation of the cooling structure of the turbine blade 130 in accordance with the present invention shall be described.

As in the ninth embodiment, the cooling air introduced into the first inflow path 6 from the first intake opening 111 gradually flows toward the leading edge portion cavity 133 from the slit 138 formed in the partition plate 136. At this moment, when the cooling air impinges on the inner wall of the leading edge portion cavity 133, the heat is exchanged between the inner wall of the leading edge portion cavity 133 and the cooling is performed. After the heat exchange is performed, the cooling air is discharged from the film holes 20A and the slot cooling holes 21 to the outside of the blade.

As in the eighth and ninth embodiments, since the cooling air also flows into the leading edge portion cavity 133 from the first intake opening 111, on the tip surface 130*e* of the leading edge 130*a*, no stagnation of the cooling air is created. Accordingly, it is possible to obtain a substantially uniform heat transfer coefficient distribution from the tip surface 130*e* of the leading edge 130*a* to the hub surface 130*f*. Therefore, substantially the whole surface of the leading edge 130*a* is cooled substantially uniformly.

As described above, preferred embodiments of the present invention are described. However, the present invention shall not be limited to these embodiments. Various changes, such as adding, omitting, alternating, or the like of the structural elements are possible, provided they do not depart from the scope of the present invention. The present invention shall not be limited by the above described description but only limited by the attached claims.

For example, in the above embodiments, the cooling structure of the turbine blade or turbine nozzle band are described, however, the structure can be applied to a turbine shroud or other cooling structures of wall surfaces, which are exposed to a high temperature.

INDUSTRIAL APPLICABILITY

The cooling structure of the present invention can be applied to turbine blades or turbine nozzle bands. Furthermore, the cooling structure of the present invention can be applied to turbine shrouds or other wall surfaces, which are exposed to a high temperature.

The invention claimed is:

1. A cooling structure for a structural body, which configures a turbine, having wall surfaces provided along a high temperature combustion gas flowing substantially in the direction of an axial line of the turbine comprising:

a cooling flow path provided in a space defined between the wall surfaces in the structural body meandering around a flow direction of the high temperature combustion gas;

an inflow path for a cooling air formed inside of the structural body in which the cooling flow path extends in a direction substantially perpendicular to the axial direction;

at least one straight flow path provided with intervals substantially in the axial direction, in which a length substantially the same as the length of the inflow path is a flow path width and extended substantially in the normal direction of the wall surface by a finite length; and a turning flow path for communicating the ends of the inflow path with the straight flow path or communicating the ends of each of the straight paths one after the other, wherein the wall surfaces are a suction surface and a pressure surface of the turbine blade, the cooling flow path has a first flow path and a second flow path directing from the center portion of the turbine blade to the leading edge thereof and to the trailing edge thereof respectively, each of the first flow path and the second flow path has the inflow path, the straight flow path, and the turning flow path;

each of the inflow paths of the first flow path and the second flow path is formed along the height direction of the turbine blade and is provided to be adjacent with one another.

2. The cooling structure in accordance with claim 1, further comprising:

an air intake opening for intaking the cooling air into the cooling flow path provided on a tip surface or a hub surface of the turbine blade so as to communicate with substantially the whole region of the first flow path.

3. The cooling structure in accordance with claim 1, further comprising:

a plurality of turbulence promoters provided along the inflow path.

4. The cooling structure in accordance with claim 1, further comprising:

a plurality of fins or turbulence promoters, edge portions of which are connected to the suction surface and the pressure surface, provided closer to the trailing edge from the second flow path.

5. The cooling structure in accordance with claim 1, wherein a proximal end of the first flow path is communicated with an outlet hole provided in the leading edge of the turbine blade.

6. The cooling structure in accordance with claim 1, further comprising:

a partition portion for plurally dividing the straight flow path and the turning flow path in the height direction of the blade.

7. The cooling structure in accordance with claim 1, wherein the first inflow path and the second inflow path are formed to be gradually narrowed in the height direction of the turbine blade when the inflow path of the first flow path is the first inflow path and the inflow path of the second flow path is the second inflow path so that the cooling air flowing in the first inflow path and the second inflow path flow in opposite direction with one another.

8. The cooling structure in accordance with claim 1, further comprising:

fins set up in the middle of the turning flow path.

9. The cooling structure in accordance with claim 8, wherein the turbine promoters are set up instead of the fins.

10. The cooling structure in accordance with claim 1, wherein the wall surfaces have an inner wall surface for directly contacting the high temperature combustion gas and an outer wall surface provided to the outer side of the radial direction of the turbine from the inner wall surface, and the cooling flow path is formed between the inner wall surface and the outer wall surface.

11. The cooling structure in accordance with claim 10, wherein the height of the turning flow path in the outer wall surface side is higher than the height thereof in the inner wall surface side.

12. A cooling structure for a structural body, which configures a turbine, having wall surfaces provided along a high temperature combustion gas flowing substantially in the direction of an axial line of the turbine comprising:

a cooling flow path provided in a space defined between the wall surfaces in the structural body meandering around a flow direction of the high temperature combustion gas;

an inflow path for a cooling air formed inside of the structural body in which the cooling flow path extends in a direction substantially perpendicular to the axial direction;

at least one straight flow path provided with intervals substantially in the axial direction, in which a length substantially the same as the length of the inflow path is a flow path width and extended substantially in the normal direction of the wall surface by a finite length; and a turning flow path for communicating the ends of the inflow path with the straight flow path or communicating the ends of each of the straight paths one after the other, wherein the wall is surfaces are the suction surface and the pressure surface of the turbine blade, the cooling flow path has the first flow path and the second flow path directing from the center portion of the turbine blade to the leading edge thereof and from the trailing edge to the center portion respectively, each of the first flow path and the second flow path has the inflow path, the straight flow path, and the turning flow path, and a trailing edge inflow path for the cooling air substantially identically shaped as the inflow path provided closer to the trailing edge from the second flow path substantially in the same direction as the inflow path.

13. A cooling structure for a structural body, which configures a turbine, having wall surfaces provided along a high temperature combustion gas flowing substantially in the direction of an axial line of the turbine comprising:

a cooling flow path provided in a space defined between the wall surfaces in the structural body meandering around a flow direction of the high temperature combustion gas;

an inflow path for a cooling air formed inside of the structural body in which the cooling flow path extends in a direction substantially perpendicular to the axial direction;

at least one straight flow path provided with intervals substantially in the axial direction, in which a length substantially the same as the length of the inflow path is a flow path width and extended substantially in the normal direction of the wall surface by a finite length; and a turning flow path for communicating the ends of the inflow path with the straight flow path or communicating the ends of each of the straight paths one after the other, wherein the wall surfaces are the suction surface and the pressure surface of the turbine blade, the cooling flow path has a first flow path and a second flow path directing from the center portion of the turbine blade to the leading edge thereof and to the trailing edge thereof respectively, the first flow path has at least the inflow path, the second flow path has the inflow path, the straight flow path, and the turning flow path, and the inflow paths of each of the first flow path and the second flow path are formed along the height direction of the turbine blade and are provided to be adjacent with one another.

14. The cooling structure in accordance with claim 13, further comprising:

a partition portion for dividing the first flow path into two portions in the longitudinal direction of the blade, and a plurality of cooling holes for communicating the front space with the rear space, which are partitioned by the partition portion.

15. The cooling structure in accordance with claim 13, further comprising:

a partition portion for dividing the first flow path into two portions in the longitudinal direction of the blade, and a slit extending in the height direction of the blade and communicating the front space with the rear space, which are partitioned by the partition portion.

* * * * *